US006530812B2

(12) United States Patent
Koyano et al.

(10) Patent No.: US 6,530,812 B2
(45) Date of Patent: Mar. 11, 2003

(54) SECONDARY THRUST ARRANGEMENT FOR SMALL WATERCRAFT

(75) Inventors: Satoshi Koyano, Shizuoka (JP); Hisato Yamada, Shizuoka (JP); Koju Tsukahara, Shizuoka (JP); Tsuide Yanagihara, Shizuoka (JP); Yusuke Aoyama, Shizuoka (JP); Yoshihiro Gahara, Shizuoka (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 09/813,438

(22) Filed: Mar. 19, 2001

(65) Prior Publication Data

US 2002/0077008 A1 Jun. 20, 2002

(30) Foreign Application Priority Data

Mar. 17, 2000 (JP) ..... 2000-077081
Jan. 31, 2001 (JP) ..... 2001-022733

(51) Int. Cl.[7] ..... B63H 11/00
(52) U.S. Cl. ..... 440/38; 440/40; 440/42

(58) Field of Search ..... 440/38, 39, 40, 440/41, 42, 43; 114/144 R, 151

(56) References Cited

U.S. PATENT DOCUMENTS 5,096,446 A * 3/1992 Tazaki et al. ..... 114/55.5
6,009,822 A 1/2000 Aron
6,146,219 A * 11/2000 Blanchard ..... 114/151
6,159,059 A 12/2000 Bernier et al.
6,183,318 B1 2/2001 Tsumiyama et al.

* cited by examiner

*Primary Examiner*—Stephen Avila
(74) *Attorney, Agent, or Firm*—Knobbe, Martens, Olson & Bear, LLP

(57) ABSTRACT

A jet propulsion unit for a small watercraft including a secondary thrust arrangement. The secondary thrust arrangement includes a primary valve and a secondary valve arrangement. At least one discharge port is disposed on a hull of the watercraft. A jet propulsion unit is configured to discharge pressurized water from the steering nozzle in a substantially rearward direction from the watercraft or to discharge pressurized water through at least one discharge port disposed in the outer surface of the hull to achieve enhanced steering control of the watercraft.

29 Claims, 17 Drawing Sheets

SECONDARY THRUST ARRANGEMENT FOR SMALL WATERCRAFT

PRIORITY INFORMATION

The present application is based upon and claims priority to Japanese Patent Application No. 2000-077081, filed Mar. 17, 2000 and Japanese Patent Application No. 2000-022733, Jan. 31, 2001, the entire contents of which are hereby incorporated by reference.

BACKGROUND OF THE INVENTION

1. Field of the Invention

The present invention relates to a jet propulsion unit for a watercraft, and more particularly, to a secondary thrust arrangement for a small watercraft.

2. Description of the Related Art

Personal watercraft have become very popular in recent years. This type of watercraft is quite sporting in nature and carries a rider and possibly one or more passengers. A relatively small hull in the personal watercraft commonly defines a rider's area above an engine compartment. An internal combustion engine frequently powers a jet propulsion unit which propels the watercraft. The engine lies within the engine compartment in front of a tunnel formed on the underside of the watercraft hull. The jet propulsion unit is located within the tunnel and is driven by an output shaft of the engine. In particular, an impeller shaft of the jet propulsion unit extends forward, through a wall of the hull tunnel, and is coupled to the engine output shaft. In this manner, the engine drives the jet propulsion unit.

The jet propulsion unit conventionally includes an impeller housing in which an impeller is contained. The impeller, which is driven by the engine through the impeller shaft, draws water through a water inlet and forces it through a discharge nozzle to propel the watercraft. A steering nozzle usually is mounted on the discharge nozzle for pivotal movement about a vertical axis. Pivotal movement of the steering nozzle about the vertical steering axis alters a discharge direction of the water jet to steer the watercraft.

Many personal watercraft also include a reverse thrust deflector or "bucket" to issue water forwardly and produce a reverse thrust. A pair of support arms typically support the reverse thrust deflector about the end of the jet propulsion unit. These arms usually are pivotally mounted onto the discharge nozzle or onto a ride plate that extends beneath at least a portion of the jet propulsion unit. The pivotal movement of the arms moves the reverse thrust deflector from a raised position, in which the deflector does not affect the water jet issuing from the steering nozzle, and a fully lowered position, in which the deflector cooperates with the steering nozzle and redirects water issuing from the jet propulsion unit forwardly to achieve a reverse thrust. However, this method of producing a reverse thrust is mechanically inefficient and does not allow for precise steering during reverse motion of the watercraft.

SUMMARY OF THE INVENTION

A need therefore exists for a watercraft thrust arrangement that provides for precise steering movements during reversal of the watercraft and enhanced steering control of the watercraft during forward motion.

One aspect of the present invention is a secondary thrust arrangement configured to provide enhanced steering control of a small watercraft. The secondary thrust arrangement may also be configured to inhibit "diving" of a bow portion of a small watercraft during deceleration. Additionally, the secondary thrust arrangement may be configured to provide precise directional control of the watercraft during low speed docking maneuvers.

In one mode, a watercraft comprising a hull is provided. The hull includes a lower hull portion and an upper deck portion. A handlebar assembly is disposed on the upper deck portion. An engine compartment is defined between the lower hull portion and the upper deck portion and an internal combustion engine is disposed within the engine compartment. A jet propulsion unit, which includes a water inlet, a discharge nozzle, and an impeller driven by the internal combustion engine, is provided. A steering nozzle is disposed on a downstream side of the discharge nozzle, and is configured to pivot about a substantially vertical axis. The jet propulsion unit is configured to, in a first mode, discharge pressurized water from the steering nozzle in a substantially rearward direction from the watercraft. The jet propulsion unit is additionally configured to, in a second mode, discharge pressurized water through at least one discharge port disposed on an outer surface of the hull.

In another mode, a watercraft comprises a hull, the hull including a lower hull portion and an upper deck portion is provided. A handlebar assembly is disposed on the upper deck portion. An engine compartment is defined between the lower hull portion and the upper deck portion. An internal combustion engine is disposed within the engine compartment. A jet propulsion unit comprising a water inlet, a discharge nozzle, and an impeller driven by the internal combustion engine is also provided. A steering nozzle is disposed on a downstream side of the discharge nozzle, the steering nozzle is configured to pivot about a substantially vertical axis. The jet propulsion unit is configured to discharge pressurized water from the steering nozzle in a substantially rearward direction from the watercraft. Means for diverting water from the jet propulsion unit through a discharge disposed on the hull is also provided.

In yet another mode, a watercraft comprises a hull which includes a lower hull portion and an upper deck portion. An engine compartment is defined between the lower hull portion and the upper deck portion. An internal combustion engine is disposed within the engine compartment. A jet propulsion unit is powered by the internal combustion engine. The jet propulsion unit includes a nozzle. The hull includes at least one inlet and at least one discharge port. At least one secondary flow passage is provided connecting the at least one inlet and the at least one discharge port. A water diverter assembly is pivotally supported relative to the nozzle and moveable between a first position and a second position. The water diverter assembly is disposed relative to the nozzle so as to direct at least a portion of a water stream issuing from the nozzle toward the at least one inlet.

In a further mode, a watercraft comprises a hull including a lower hull portion and an upper deck portion. An engine compartment is defined between the lower hull portion and upper deck portion. An internal combustion engine is disposed in the engine compartment and a jet propulsion unit is powered by the internal combustion engine. The jet propulsion unit includes a nozzle and the hull includes at least one inlet and at least one discharge port. At least one secondary flow passage connects the at least one inlet and the at least one discharge port. A water diverter assembly is pivotally supported relative to the nozzle and moveable between a first position and a second position. The water diverter assembly is disposed relative to the nozzle so as to direct at least a portion of a water stream issuing from the nozzle toward the at least one inlet.

In still a further mode, a watercraft comprises a hull including a lower hull portion and an upper deck portion. An engine compartment is defined between the lower hull portion and upper deck portion and an internal combustion engine is disposed in the engine compartment. A jet propulsion unit is powered by the internal combustion engine and includes a discharge nozzle, a steering nozzle and at least one discharge port configured to produce a steering thrust.

Further aspects, features, and advantages of the present invention will become apparent from the detailed description of the preferred embodiments which follows.

BRIEF DESCRIPTION OF THE DRAWINGS

The above-mentioned and other features of the invention will now be described with reference to the drawings of the preferred embodiments of the present secondary thrust arrangement in the context of a personal watercraft. The illustrated embodiments of the secondary thrust arrangement are intended to illustrate, but not to limit the invention. The drawings contain the following figures:

FIG. 14*a* is a side view of the secondary thrust arrangement shown in

FIG. 11 with the thrust deflector in a raised position;

FIG. 14*c* is a side view of the secondary thrust arrangement shown in

FIG. 14*a* with the thrust deflector in a lowered position;

Hire 14*d* is a rear view of the secondary thrust arrangement shown in

Figure 11:
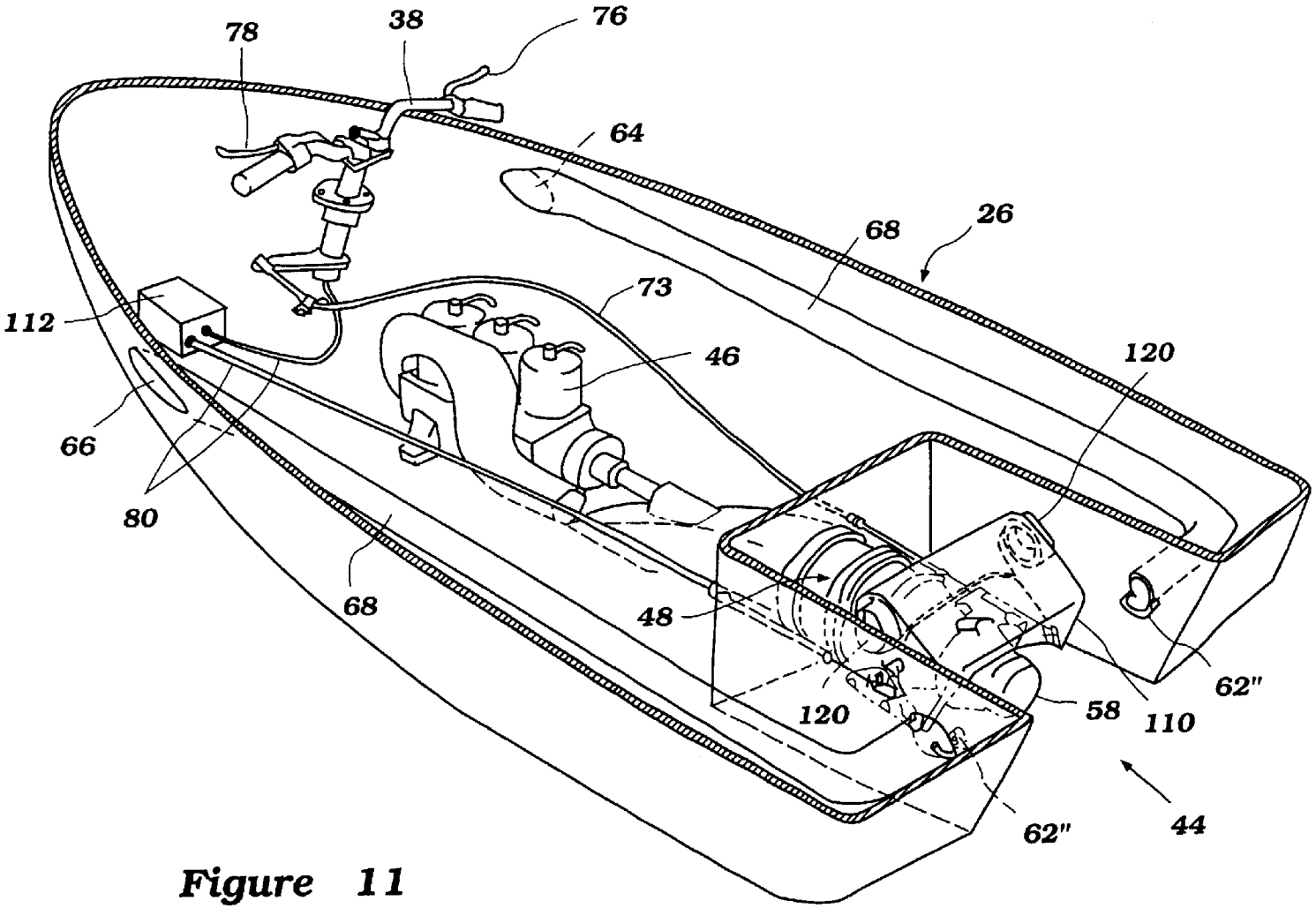
FIG. 11 is a perspective view of a another modification of the secondary thrust arrangement shown in FIG. 1, including a reverse thrust deflector.
Figure 14B:
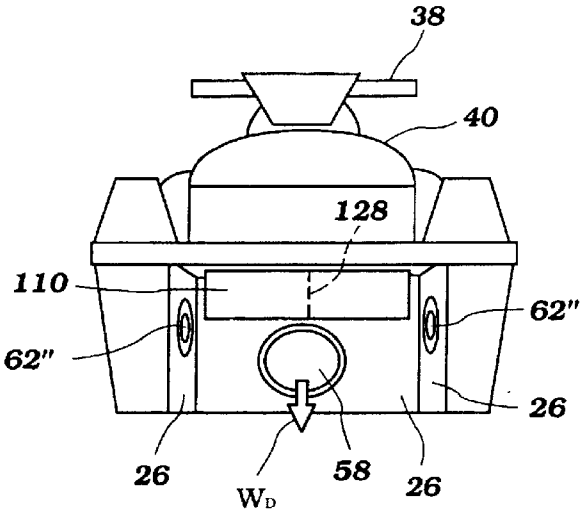
FIG. 14*b* is a rear view of the secondary thrust arrangement shown in FIG. 14*a* with the thrust deflector in a raised position.
Figure 14D:
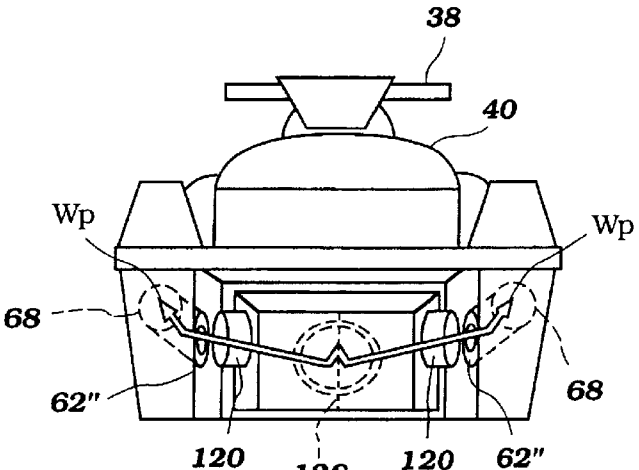
Figure 14A:
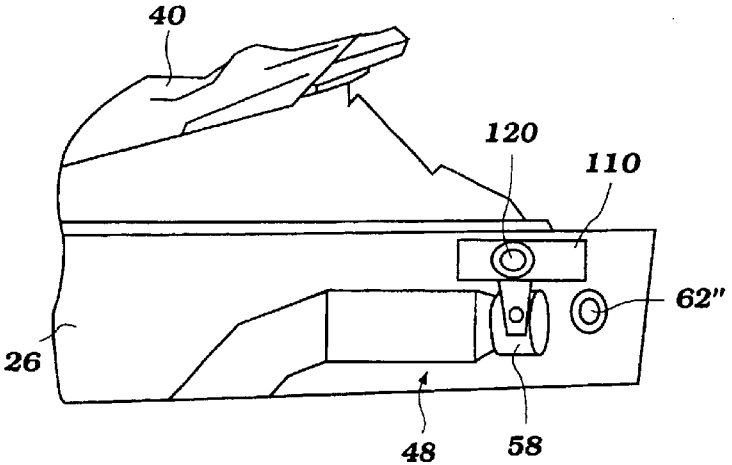
Figure 14C:
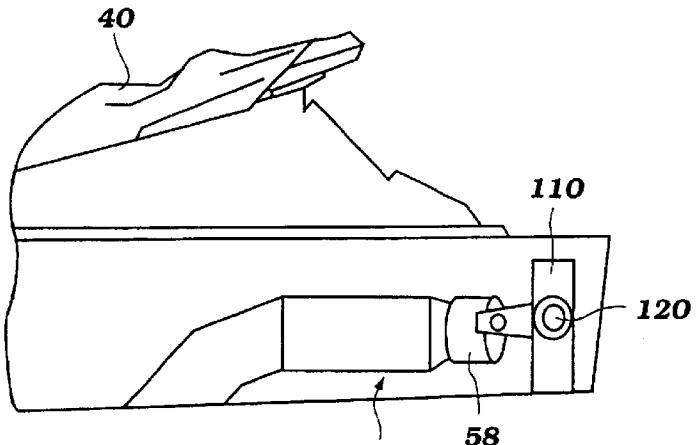
Figure 15A:
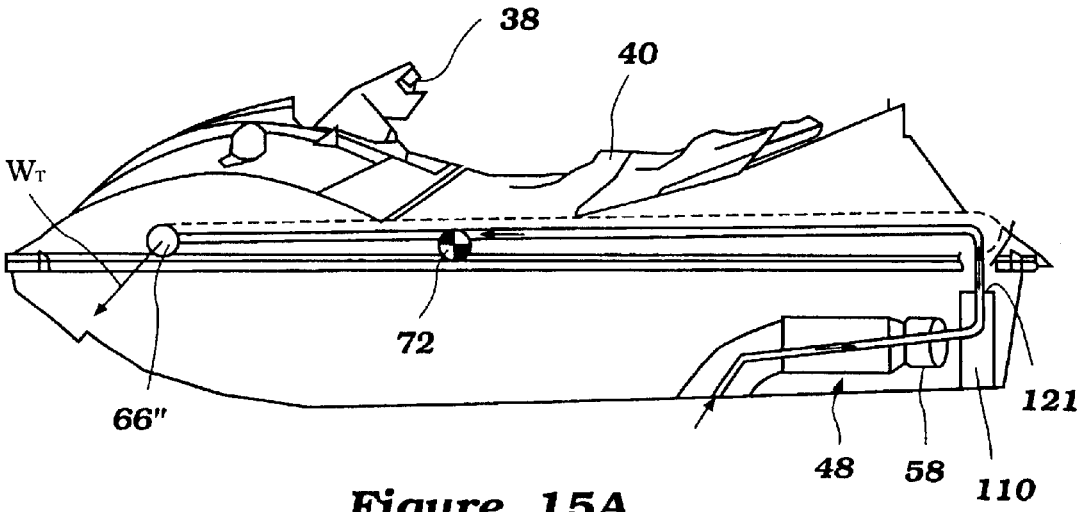
Figure 15B:
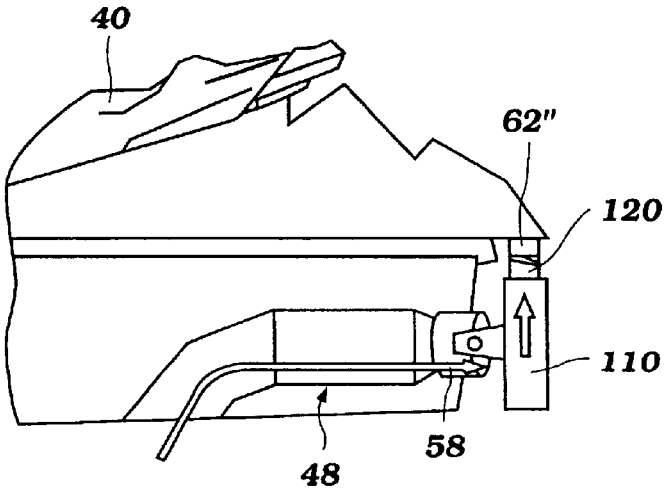

FIG. 14*a* with the thrust deflector in a lowered position;

FIG. 15*a* is a side elevational view of a watercraft including a modification of the secondary thrust arrangement shown in FIG. 11;

FIG. 15*b* is an enlarged partial cutaway side elevational view of a transom portion of the watercraft of FIG. 15*a;*

Figure 15C:
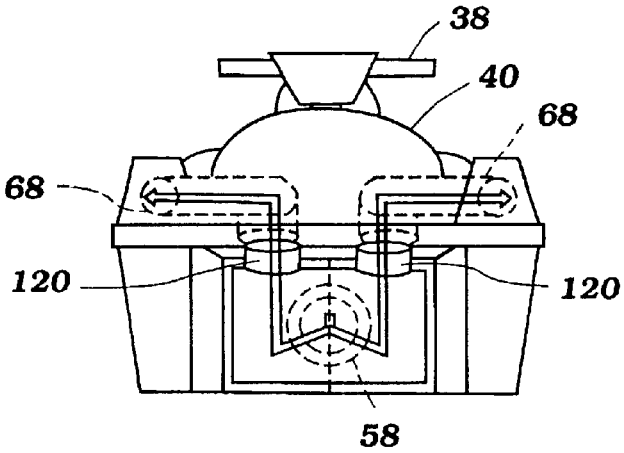

FIG. 15*c* is a rear view of the watercraft of FIG. 15*a;*

Figure 1:
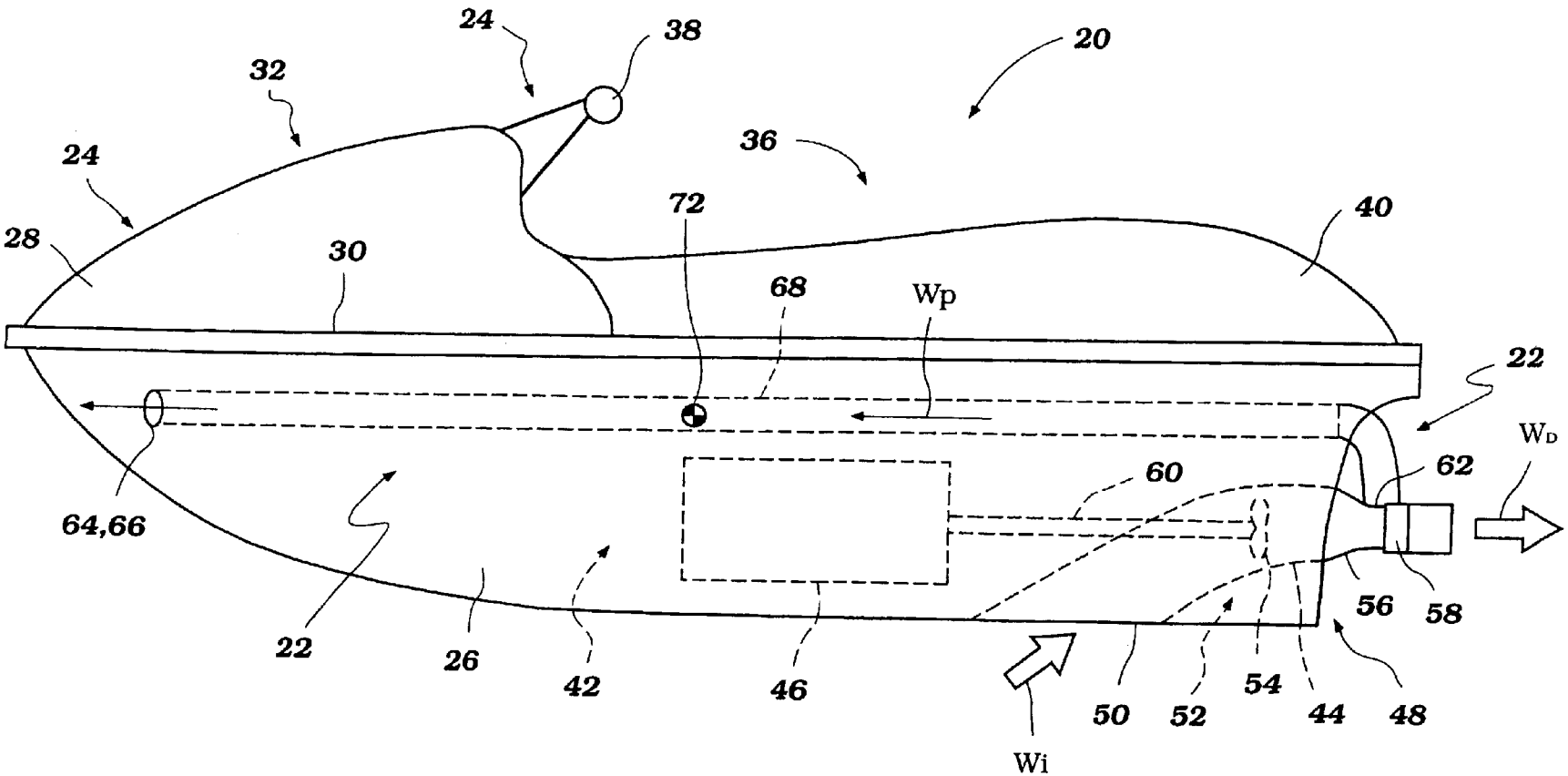
FIG. 1 is a side elevational view of a small watercraft, having a jet propulsion unit including a secondary thrust arrangement configured in accordance with a preferred embodiment of the present invention, and illustrates several internal components the watercraft in phantom, including a jet propulsion unit.
Figure 16:
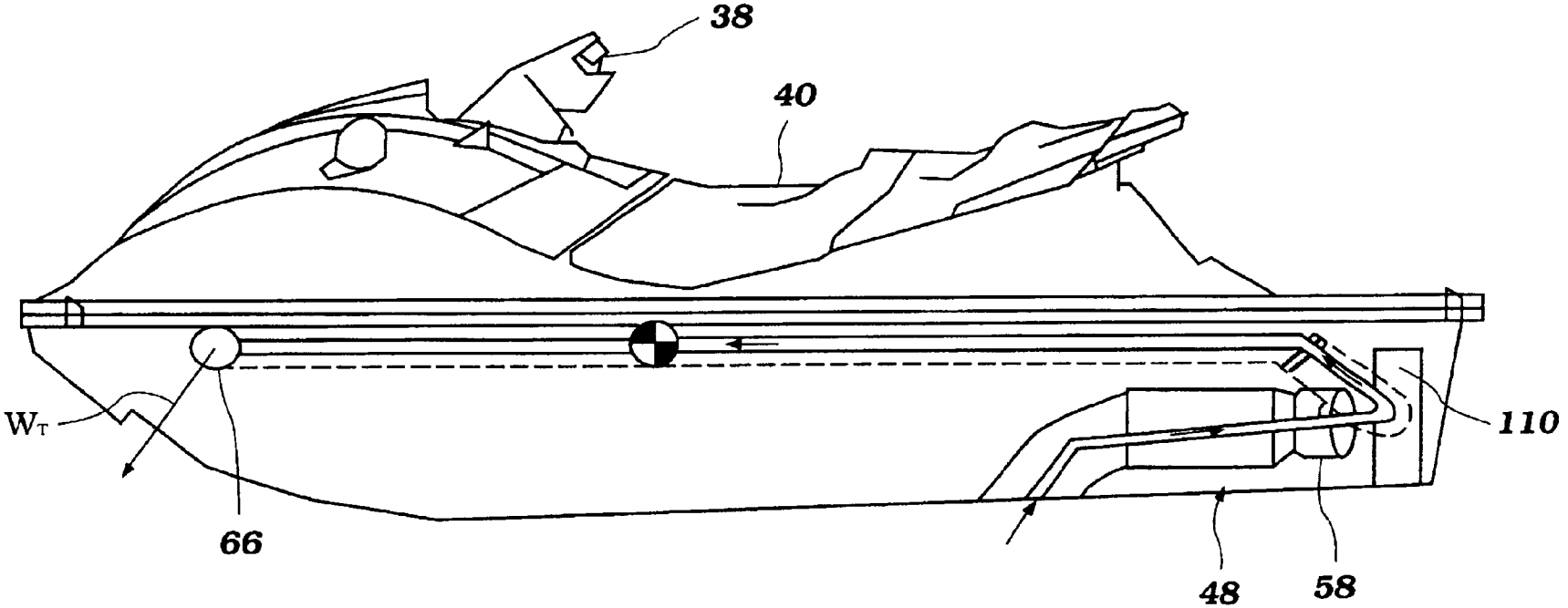
Figure 17:
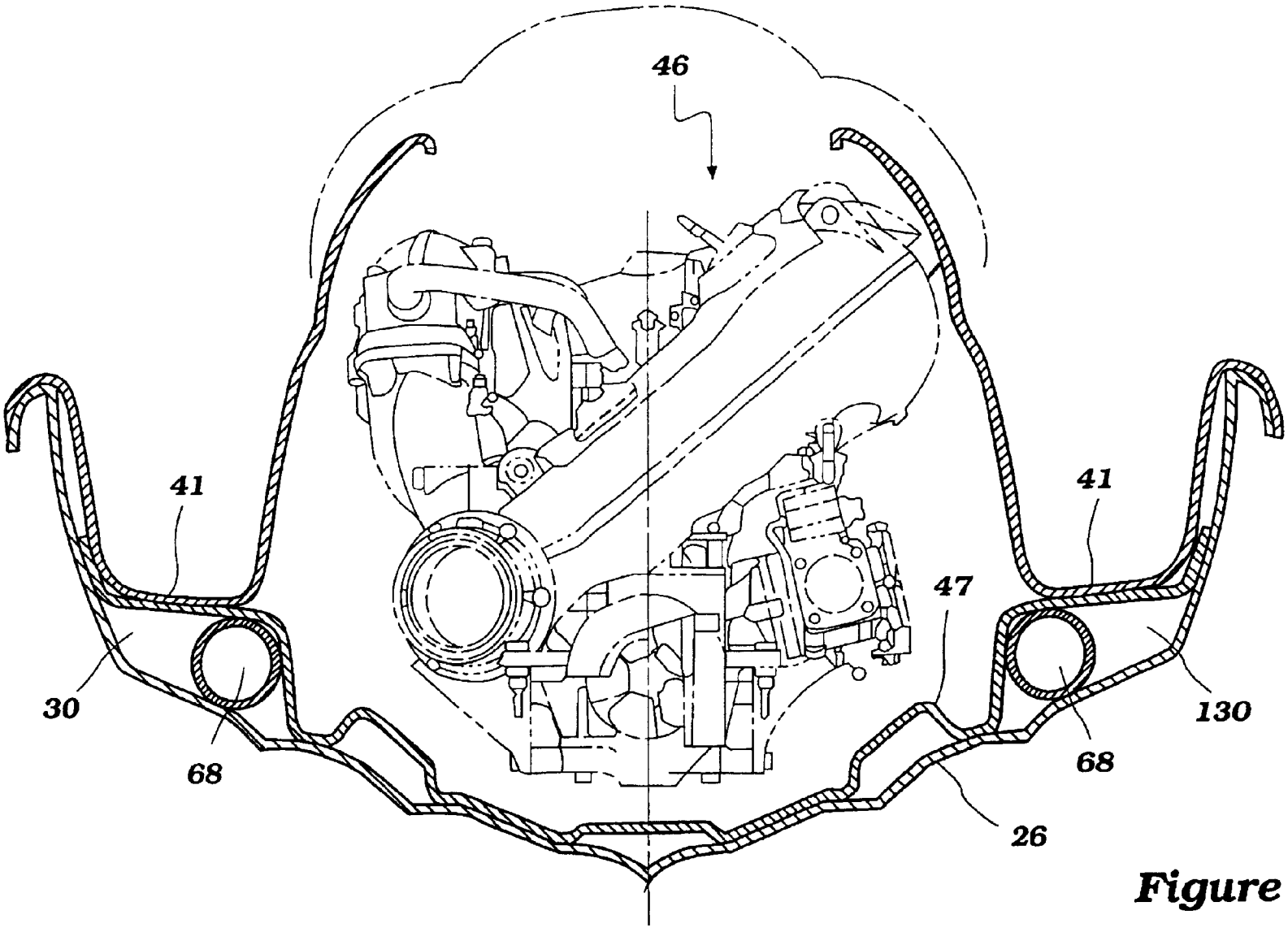

FIG. 16 is a side elevational view of a watercraft including yet another modification of the secondary thrust arrangement shown in FIG. 1;

FIG. 17 is a cross-sectional view of a watercraft constructed in accordance with the present invention illustrating a pair of secondary flow passages arranged within the hull of the watercraft.

DETAILED DESCRIPTION OF THE PREFERRED EMBODIMENT

Figure 2:
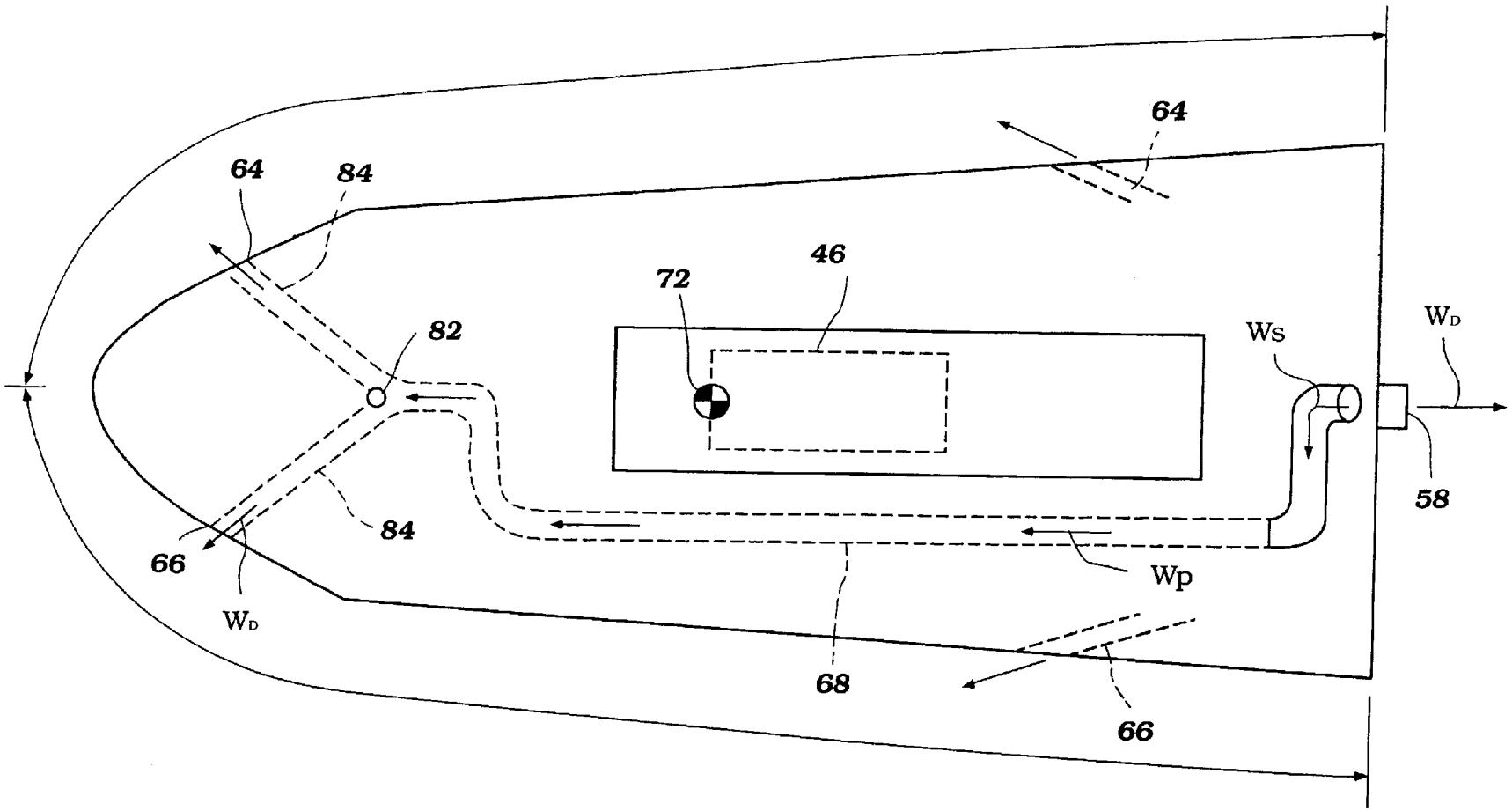
FIG. 2 is a top plan view of the small watercraft of FIG. 1, with several internal components of the watercraft illustrated in phantom.

FIGS. 1 and 2 illustrate a personal watercraft 20 which includes a secondary thrust arrangement 22 configured in accordance with a preferred embodiment of the present invention. Although the present secondary thrust arrangement 22 is illustrated in connection with a personal watercraft, the secondary thrust arrangement 22 can be used with other types of watercraft as well, such as, for example, but without limitation, small jet boats and the like. Before describing the secondary thrust arrangement 22, an exemplary personal watercraft 20 will first be described in general details to assist the reader's understanding of the environment of use in the operation of the secondary thrust arrangement 22.

With reference primarily to FIG. 1, a small watercraft 20 includes a hull 24 formed by a lower hull section 26 and an upper deck section 28. The hull sections 26, 28 are formed from a suitable material such as, for example, a molded fiberglass reinforced resin. The lower hull section 26 and the upper deck section 28 are affixed to each other around the peripheral edges 30 in any suitable manner.

As viewed in the direction from the bow to the stern of the watercraft, the upper deck section 28 includes a bow portion 32, a control mast 34, and a rider's area 36. The bow portion 32 slopes upwardly toward the control mast 34 and desirably includes an air plenum (not shown) that receives atmospheric air through at least one intake opening (not shown). Preferably, an air duct (not shown) connects the air plenum to an interior space within the hull 24.

The control mast 34 extends upward from the bow portion 32 and supports a handlebar assembly 38. The handlebar 38 controls the steering of the watercraft 20. The handlebar assembly 38 also carries a variety of controls of the watercraft 20, such as, for example, a throttle control, a start switch, and additional controls described in more detail below.

The rider's area 36 lies behind the control mast 34 and includes a seat assembly 40. In the illustrated embodiment, the seat assembly 40 has a longitudinally extending straddle-type shape that may be straddled by an operator and by at least one or more passengers. Preferably, a pair of foot areas 41 (FIG. 17) extend generally longitudinally and parallel to the sides of the seat assembly 40.

The lower hull portion 26 cooperates with the upper deck portion 26 to define the engine compartment 42 of the watercraft 20. Except for air ducts (not shown), the engine compartment 42 is normally substantially sealed so as to enclose an engine of the watercraft 20 from the body of water in which the watercraft is operated.

The lower hull 26 is designed such that the watercraft 20 planes or rides on a minimum surface area at the aft end of the lower hull 26 in order to optimize the speed and handling of the watercraft 20 when up on plane. For this purpose, the lower hull section 26 generally has a V-shaped configuration formed by a pair of inclined sections that extend outwardly from a keel line of the hull to the hull's sidewalls at a dead rise angle. The inclined sections also extend longitudinally from the bow toward the transom of the lower hull 26. The sidewalls are generally flat and straight near the stern of the lower hull 26 and smoothly blend toward the longitudinal center of the watercraft 20 at the bow 32. The lines of intersection between each inclined section and the corresponding sidewall form the outer chine of the lower hull 26.

Toward the transom of the watercraft, the inclined sections of the lower hull 26 extend outwardly from a recess channel or tunnel 44 that extends upward toward the upper deck portion 28. The tunnel 44 has a generally parallelepiped shape and opens through the rear of the transom of the watercraft 20.

An internal combustion engine 46 powers the watercraft 20. The engine 46 is positioned within the engine compartment 42 and is mounted primarily beneath the seat assembly 40. Vibration absorbing engine mounts secure the engine 46 to the lower hull portion 26 in a known manner. Optionally, the engine mounts can be supported by a liner 47 (FIG. 17) disposed in the engine compartment 42. The engine 46 is mounted in approximately a central position of the watercraft 20.

A cylinder block and a cylinder head assembly desirably form the cylinders of the engine 46. A piston reciprocates within each cylinder of the engine 46 and together the pistons drive an output shaft. A connecting rod links the corresponding piston to a crankshaft of the engine, which in time is drivingly connected to the output shaft by a coupling. The corresponding cylinder bore, piston and cylinder head of each cylinder forms a variable volume chamber, which at a minimum volume defines a combustion chamber.

The crankshaft desirably is journaled within a crankcase, which in one variation, is formed between a crankcase member and a lower end of the cylinder block. Individual crankcase chambers of the engine are formed within the crankcase by dividing walls and sealing disks, and are sealed from one another with each crankcase chamber communicating with a dedicated variable volume chamber.

Each crankcase chamber also communicates with an intake passage of an induction system (not shown) through a check valve (e.g., a reed-type valve). In one variation, the intake passages are integrally formed with the crankcase member; however, the engine 46 can also use a separate intake manifold equally well. Those skilled in the art will readily appreciate that the present secondary thrust arrangement can be used with any of a variety of engine types, such as those that operate on 4-cycle, deisel or rotary combustion principles. Additionally, the engines may have varying number of cylinders and varying cylinder arrangements, such as an in-line, V-type or W-type arrangement. As such, the engine 46 operates under the 2-cycle, crankcase compression principle.

A charge former (e.g., a carburetor) of the induction system communicates with an inlet end of the intake passage. The charge former system receives fuel from the fuel tank and produces the fuel charge which is delivered to the cylinders in a known manner. In the illustrated embodiment, an air intake silencer is connected to an air inlet end of a throttle passage of each charge former. The flow path from the air intake silencer, through the charge former and intake passage and into the corresponding crankcase chamber desirably is along a flow axis which generally is inclined relative to the central vertical plane and lies on a side of the plane opposite of the corresponding cylinder. Because the internal details of the engine 46 and the induction system desirably are conventional, a further description of the engine construction is not believed necessary to understand and practice the invention.

A jet propulsion unit 48 propels the watercraft 20. The jet propulsion unit 48 is mounted within the tunnel 44 formed on the underside of the lower hull section 26. An intake duct of the jet propulsion unit 48 defines an inlet opening 50 that permits water to enter the jet propulsion unit 48 (as illustrated by the arrow $W_I$ in FIG. 1). The inlet opening 50 opens into a gullet which leads to an impeller housing assembly 52 in which the impeller 54 of the jet propulsion unit 48 rotates. The impeller housing assembly 52 also acts as a pressurization chamber and delivers a water flow from the impeller housing to a discharge nozzle 56.

A steering nozzle 58 is supported at the downstream end of the discharge nozzle 56 for rotation about a vertical axis. In an exemplary embodiment, the steering nozzle is coupled to the handlebar assembly 38, through, for example, a bowden wire actuator, as known in the art. In this manner, the operator of the watercraft 20 can move the steering nozzle 58 to effect directional changes of the watercraft 20.

A ride plate (not shown) covers a portion of the tunnel 44 behind the inlet opening to enclose at least partially the pump assembly and the nozzle assembly of the jet propulsion unit 48 within the tunnel 44. In this manner, the lower opening of the tunnel 44 is closed to provide a planing surface for the watercraft 20.

With reference to FIG. 1, an impeller shaft 60 supports the impeller 54 within the impeller housing assembly 52 of the jet propulsion unit 48. The impeller shaft 60 extends in a forward direction through a front wall of the tunnel 44. The front end of the impeller shaft 60 is coupled to the output shaft of the engine. In this manner, the engine 46 drives the propulsion unit 48.

FIGS. 1–5 illustrate a preferred embodiment of the secondary thrust arrangement 22. As shown in FIGS. 3*a* and 3*b*, a secondary inlet 62 is defined within the discharge nozzle 56. The secondary inlet 62 is disposed on an upper portion of the discharge nozzle 56. As illustrated in FIGS. 1 and 2, the secondary thrust arrangement 22 additionally comprises at least one, and preferably a pair, of discharge ports 64, 66 disposed on an outer surface of the hull 24. In the present embodiment, one of the discharge ports 64 is located on a starboard side of the bow portion 32 of the lower hull 26, and a second discharge port 66 is located on a port side of the bow portion 32 of the lower hull 26. Alternatively, the discharge ports 64, 66 may be disposed on lateral starboard and port sides of a rearward portion of the lower hull 26.

With reference to FIGS. 1 and 2, secondary flow passage 68 connects the secondary inlet 62 with the pair of discharge ports 64, 66. Preferably, the secondary flow passage 68 is disposed on a lateral side of the engine 46. Additionally, the secondary flow passage 68 extends along an elevation above the engine 46 and, preferably, an elevation containing a center of gravity 72 of the watercraft 20. Advantageously, such a construction allows the secondary thrust arrangement 22 to produce a "moment" or torque about the center of gravity 72 of the watercraft 20. Thus, thrust produced from water being expelled from the discharge ports 64, 66 rotates the watercraft 20 about its center of gravity 72.

Figure 3A:
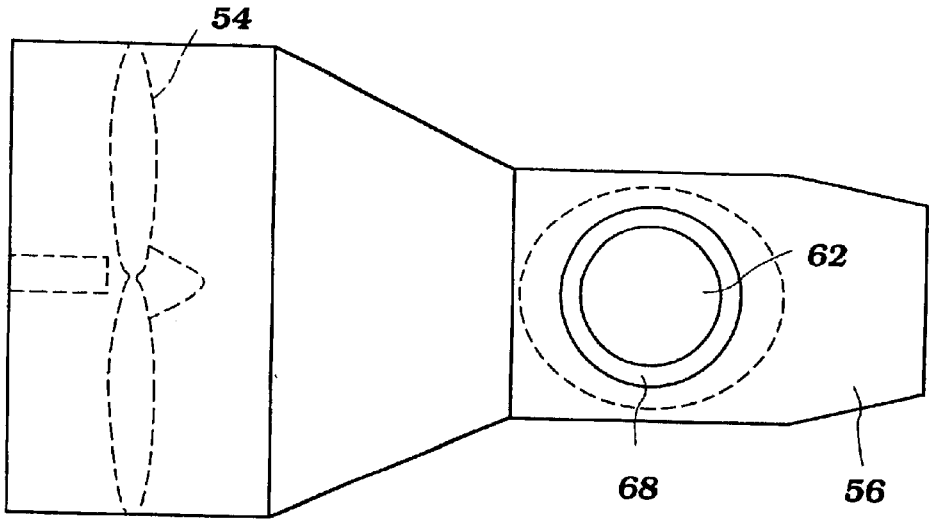
FIG. 3*a* is an enlarged top plan view of a discharge end of the jet propulsion unit.
Figure 3B:
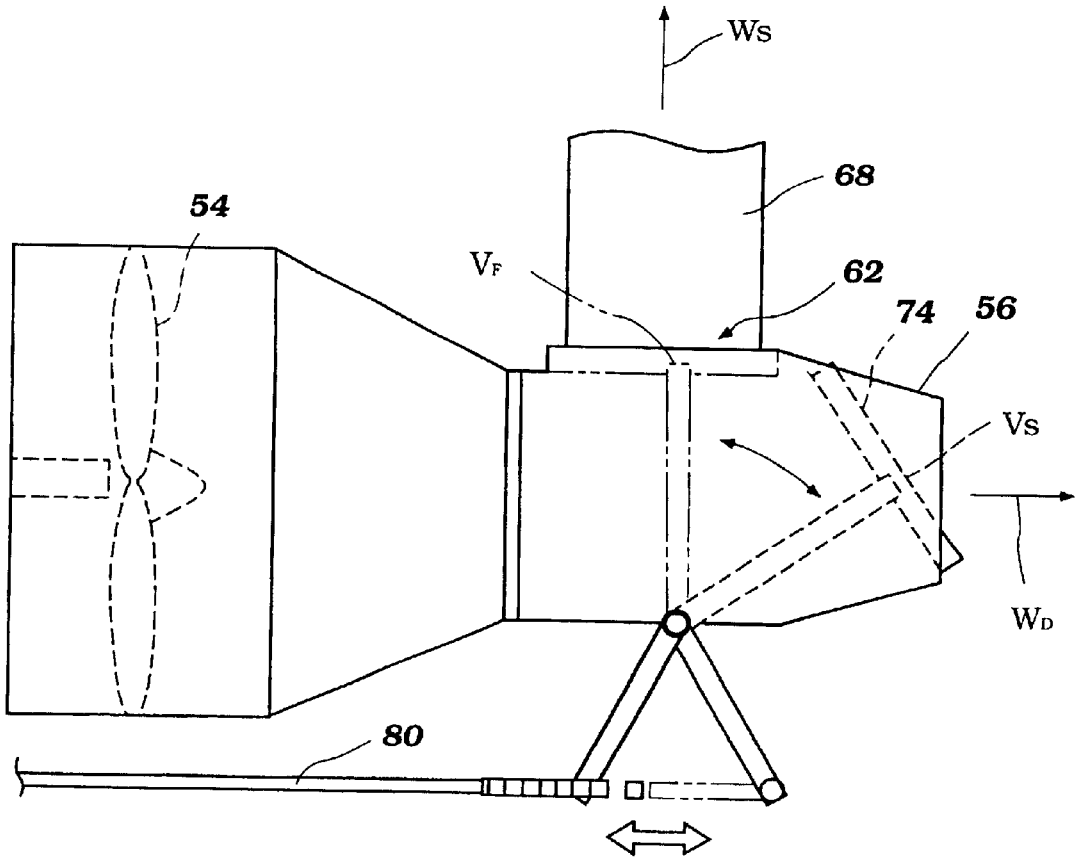
FIG. 3*b* is an elevational view of the discharge end shown in FIG. 3*a;*

As illustrated in FIG. 3*b*, the secondary thrust arrangement 22 additionally comprises a primary valve 74 configured to selectively direct water issuing from the discharge nozzle 56 (illustrated by the arrow $W_D$) in a substantially rearward direction or, alternatively, direct the water toward the secondary inlet 74 (illustrated by the arrow $W_S$). The primary valve 74 may also comprise a water diverter device, such as a thrust bucket assembly, described in more detail below.

The primary valve 74 is pivotally mounted relative to the secondary inlet 62 such that in a first, or forward, mode ($V_F$in FIG. 3*b*) water downstream from the impeller 54 is prevented from entering the secondary inlet 62 and is discharged in a substantially rearward direction from the discharge nozzle 56. In a second mode ($V_S$in FIG. 3*b*), the primary valve 74 at least partially obstructs a rearward end of a discharge nozzle 56. In the second mode, at least a porn of the water discharged from the impeller 54 is directed into the secondary inlet 62, travels through the secondary flow passage 68 (illustrated by the arrow $W_P$), and is expelled through the discharge ports 62, 64 (illustrated by the arrow $W_O$). Desirably, the primary valve 74 is sized such that a sufficient flow of water is diverted into the secondary inlet 62 to cause a net thrust in the desired direction.

Figure 4:
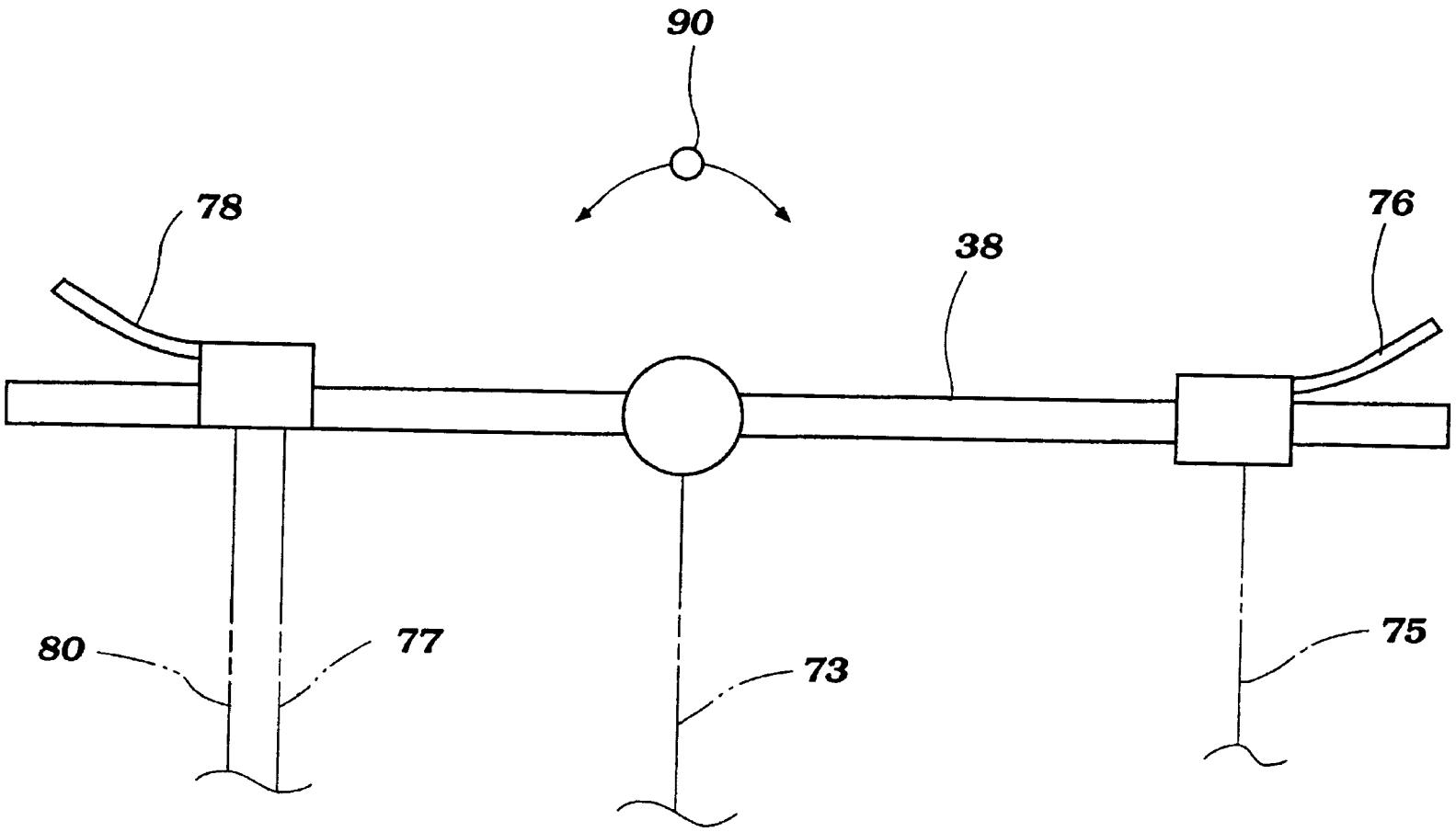
FIG. 4 is a schematic view of a handlebar assembly of the small watercraft of FIG. 1.

With reference to FIG. 4, the handlebar assembly, as noted above, is configured to control pivotal movement of the steering nozzle 58. Preferably, a flexible wire assembly 73 (e.g. a bowden-wire) connects the handlebar assembly 38 to the steering nozzle 58 to coordinate movement between the handlebar assembly 38 and steering nozzle 58 in a known manner. Accordingly, when a sufficient force is produced by the water issuing from the discharge nozzle 56, steering control of the watercraft 20 may be achieved by altering the direction of the water discharge from the steering nozzle 58.

A throttle control lever 76 is connected to the handlebar assembly 38, preferably on a right-hand side of an operator of the watercraft 20. The throttle control lever 76 is configured to adjust a volume of air entering the combustion chambers of the engine 46, and thereby adjusting engine speed. As known in the art, this function may be performed by a mechanical or electrical connection 75 between the throttle control lever 76 and the engine 46. Preferably, the connection 75 comprises the throttle control lever 76 operating a servo motor. In turn, the servo motor operates a throttle valve disposed in the air intake system of the engine 46.

A secondary control lever 78 is disposed on the left-hand side of the handlebar assembly 38 and is configured to be actuated by the left-hand of an operator of the watercraft 20. In a similar manner to the throttle control lever 76, the secondary control lever 78 is in communication with the engine 46 through connection 77, and is configured to adjust engine speed. Preferably, the connection 77 comprises a servo motor controlled arrangement as described immediately above in relation to connection 75 between the throttle control lever 76 and the engine 46.

Additionally, the secondary control lever 78 and connection 77 may be configured to adjust engine speed to a predetermined value and/or may adjust engine speed in proportion to the movement of the secondary control lever 78.

Additionally, the secondary control lever 78 is connected to the primary valve 74 through a flexible wire assembly 80 (e.g., a bowden wire). Thus, the second control lever 78 is additionally configured to switch the primary valve 74 between its first mode and its second mode.

Figure 5:
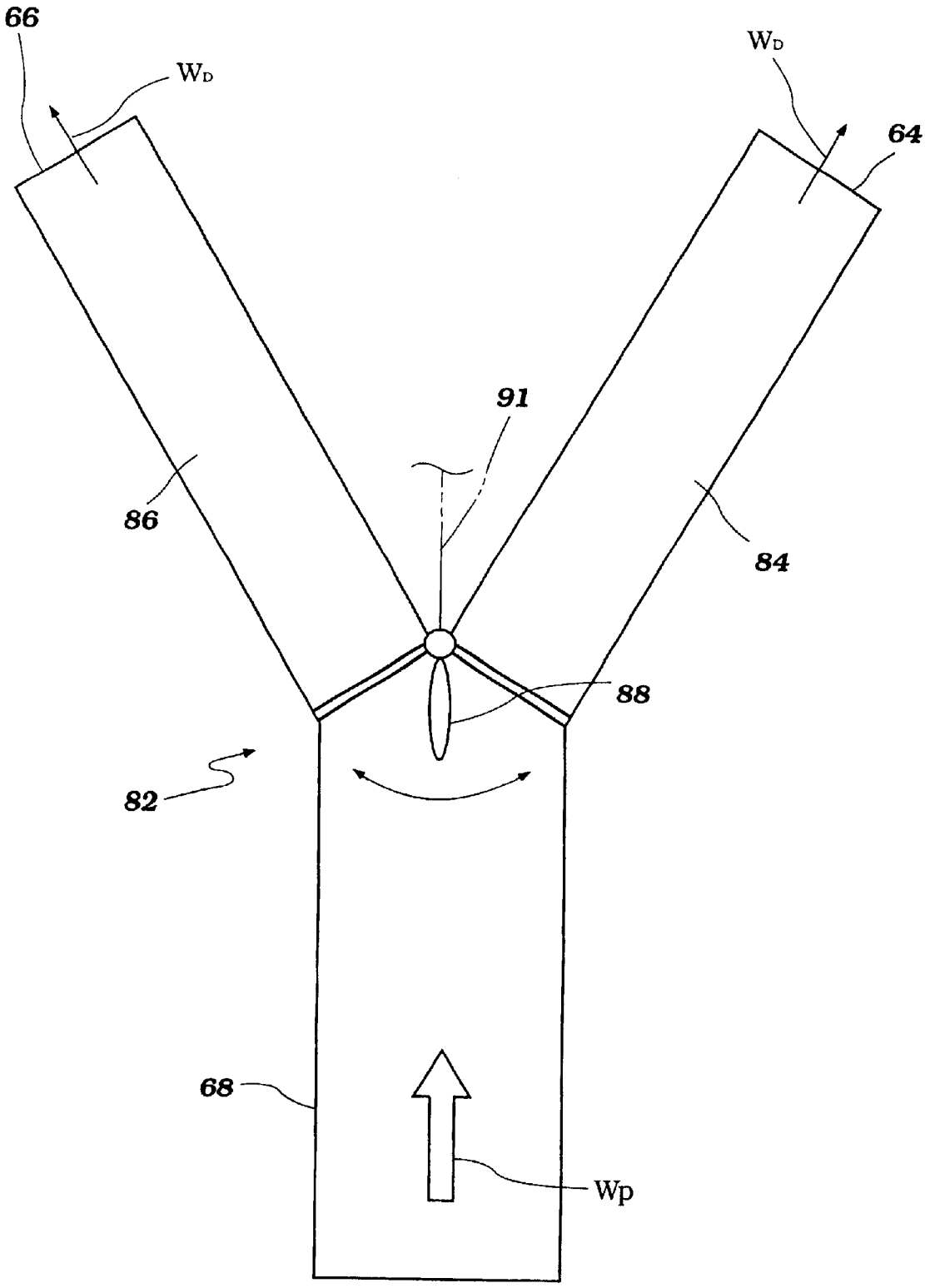
FIG. 5 is a schematic view of a secondary valve arrangement of the secondary thrust arrangement of FIG. 1.

With reference to FIGS. 2 and 5, the secondary thrust arrangement 22 also preferably includes a secondary valve arrangement 82, as illustrated FIGS. 2 and 5. The secondary valve arrangement 82 is disposed at a bifurcated portion of the secondary flow passage 68. The secondary flow passage 68 splits into starboard and port outlet branches 84, 86 which in turn lead to the starboard end port discharge part 62, 64, respectively.

The secondary valve arrangement 82 also includes a valve member 88 configured to control the flow of water between the starboard and the port outlet branches 84, 86. The valve arrangement 82 has a neutral position in which the valve member 88 is disposed to divide water substantially equally between the two outlet branches 84, 86.

The secondary valve arrangement 82 additionally is configured such that, in a first position, the valve member 88 is rotated toward the port outlet branch 86 (as indicated by the arrow in FIG. 5) to at least partially prevent water from entering the outlet branch 86. In this first position, a greater amount of water is directed to the starboard outlet branch 84 than is directed to the port outlet branch 86.

Additionally, the secondary valve arrangement 82 is configured such that, in a second position, the valve member 88 is rotated toward the starboard outlet branch 84 to at least partially prevent water from entering the outlet branch 84. In this position, the secondary valve arrangement 82 directs a greater amount of water to the port outlet branch 86 than is directed to the starboard outlet branch 84. The valve member 88 may also be configured to direct substantially all of the water flowing through the secondary flow passage 68 to either a starboard outlet branch 84 or the port outlet branch 86.

When the valve member 88 is in its first or second position, a disparity in the volume of water being expelled through the discharge port 64, 66 results in a moment about the center of gravity 72 of the watercraft 20. Thus, a steering control of the watercraft 20 may be achieved.

The secondary thrust arrangement 22 also preferably includes a handlebar position sensor 90 configured to sense a position of the handlebar assembly 38. The handlebar position sensor 90 controls the movement of the secondary valve arrangement 82 and thus the valve member 88 through an electrical or mechanical connection 91. Consequently, pivotal movement of the handlebar assembly 38 is sensed by the handlebar position sensor 90 and results in corresponding, preferably proportional, movement of the valve member 88. The handlebar position sensor 90 may comprise a proximity-type switch, in which case the handlebar assembly 38 activates the sensor 90 when rotated beyond a threshold position in either direction. Alternatively, the handlebar position sensor 90 may comprise a mechanical connection such that the valve member 88 closely follows movement of the handlebar assembly 38 throughout its range of motion.

Figure 6:
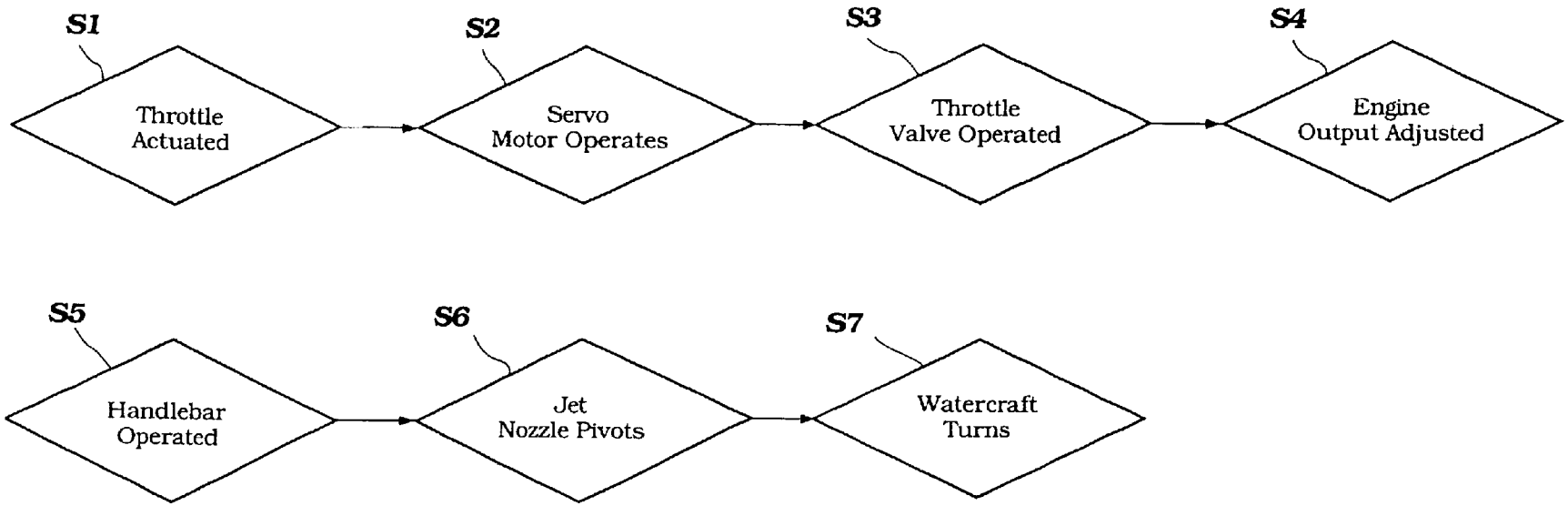
FIG. 6 is a flow chart illustrating an operation sequence the jet propulsion unit shown in FIG. 1.
Figure 7:
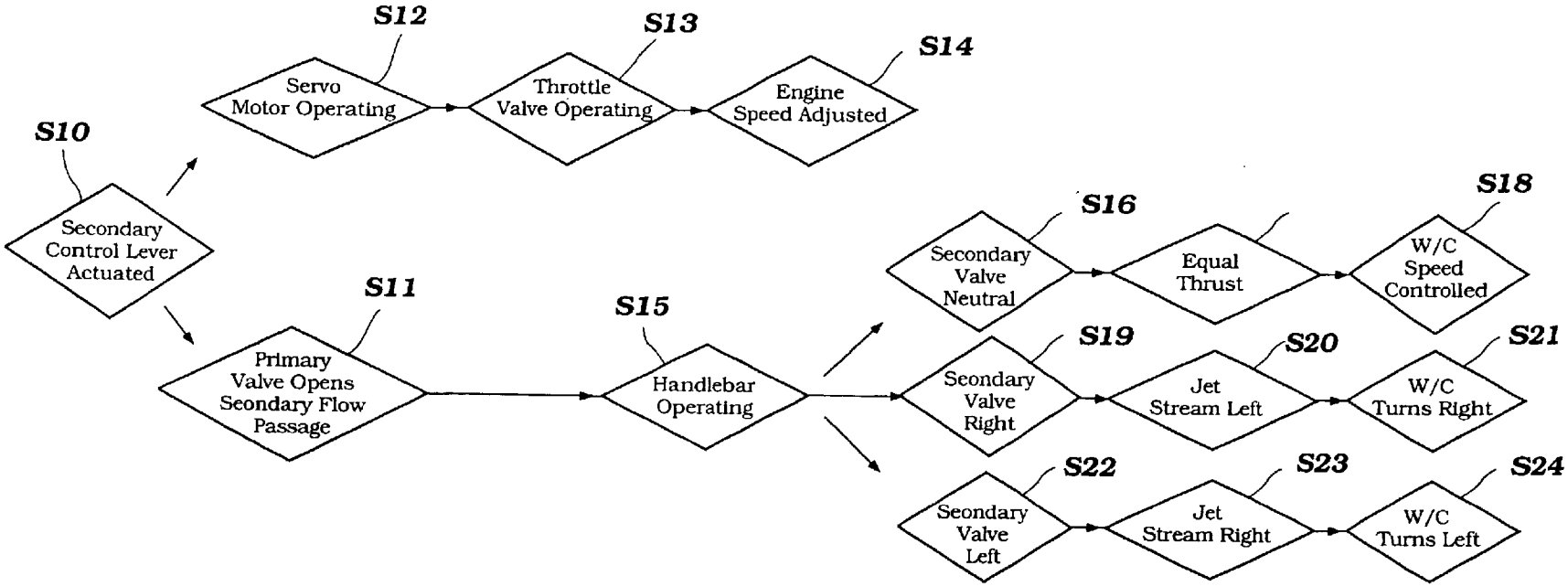
FIG. 7 is a flow chart illustrating a modification of the operational sequence shown in FIG. 6.

FIGS. 6 and 7 illustrate a presently preferred operational sequence for the jet propulsion unit 48 of the small watercraft 20. FIG. 6 is a flow chart illustrating the operational sequence of a first, or forward, mode of the jet propulsion unit 48. FIG. 7 is a flow chart of a preferred operational sequence for a secondary thrust arrangement 22 of the jet propulsion unit 48.

With reference to FIG. 6, a throttle is actuated by the operator of the watercraft 20 in a Step S1. In response to actuation of the throttle control lever 76 a servo motor is operated through the electrical connection 75 between throttle control valve 76 and the servo motor in Step S2. In Step S3, the servo motor operates a throttle valve in an air intake system of the internal combustion engine 46. Of course, in a mechanical embodiment, the throttle control lever 76 may be directly connected to the throttle valve through a flexible wire and linkage assembly. In response to operation of the throttle valve, the output speed of the engine 46 is controlled in Step S4. When the engine output speed reaches a sufficient value, sufficient thrust is produced by the jet propulsion unit 48 to propel the watercraft 20 in a forward direction. In Step S5, an operator of the watercraft 20 operates the handlebar assembly 38. In response to the operation of the handlebar assembly 38 the steering nozzle 58 is pivoted about its vertical axis in Step S6. As a result, the watercraft 20 changes direction in Step S7.

FIG. 7 illustrates a presently preferred operational sequence for the secondary thrust arrangement 22. At Step S10 an operator of the watercraft 20 actuates the secondary control lever 78. In response to the operation of the secondary control lever 78, the subroutine beginning at Step S11 and Step S12 are initiated, preferably simultaneously.

At Step S12 the operational sequence responds to the actuation of the secondary control lever 78 by operating a servo motor. The servo motor is configured to operate the throttle valve of the engine 46, as illustrated in Step S13. Operation of the throttle valve affects the output speed of the engine 46 in Step S14. The engine speed is adjusted proportionally to a value in which sufficient thrust is produced by the secondary thrust arrangement 22 in order to perform a steering operation of the watercraft 20. As mentioned previously, the engine speed may be adjusted to a predetermined value, or may be adjusted according to movement of the secondary control lever 78. Desirably, the adjustment of the engine output speed by the actuation of the secondary control lever 78 is achieved regardless of the position of the throttle lever 76. In effect, the control of the engine output speed by the secondary control lever 78 overrides control of the engine by the throttle control lever 76.

In Step S11, actuation of the secondary control lever 78 additionally results in actuation of the primary valve assembly 74. The primary valve 74 is switched from its first, or forward, mode to its second mode. Thus, water is directed into the secondary inlet 62, through the secondary flow passage 68 and is expelled through the starboard and port discharge ports 64, 66.

In Step S15, the operator of the watercraft 20 operates the handlebar assembly 38. In Step S16, the handlebar assembly 38 is in a neutral position and thus the valve member 88 distributes water substantially equally between the starboard and port discharge ports 64, 66. Thus, in Step S17 equal thrust is achieved between both discharge ports 64, 66. In Step S18, the watercraft 20 speed is controlled. In this situation, a rearward thrust is produced and the watercraft 20 is accelerated toward a rearward direction. Accordingly, if the watercraft 20 were traveling in a forward direction, the rearward thrust would initially decelerate the watercraft 20. Likewise, if the watercraft 20 were stationary, the rearward thrust would propel the watercraft 20 in a reverse direction.

In Step S19, an operator of the watercraft 20 turns the handlebar assembly 38 to the right. The valve member 88 of the secondary valve arrangement 82 is rotated toward the starboard side of the watercraft 20. In Step 20, a greater volume of water is issued from the port side discharge port 66 in comparison with the volume of water issuing from the starboard discharge port 64. In Step S21, the greater volume of water issuing from the port side discharge port 66 results in a moment about the center of gravity 72 and tends to turn the watercraft 20 towards its starboard side.

Similarly, in Step S22 the handlebar assembly 38 is turned to the left. In response, the valve member 88 pivots toward the port side of the watercraft 20. In Step S23, a greater volume of water is issued from the starboard side discharge port 64 in comparison to the volume of water issued from the port side discharge port 66. This results in the watercraft 20 turning towards its port side as illustrated in Step S24.

Advantageously, the secondary thrust arrangement 22 is capable of providing enhanced steering control of the watercraft 20. In addition, the secondary thrust arrangement 22 is also useful to provide reverse thrust to propel the watercraft 22 in a rearward direction and provide precise steering control when performing docking maneuvers, for example.

Figure 8A:
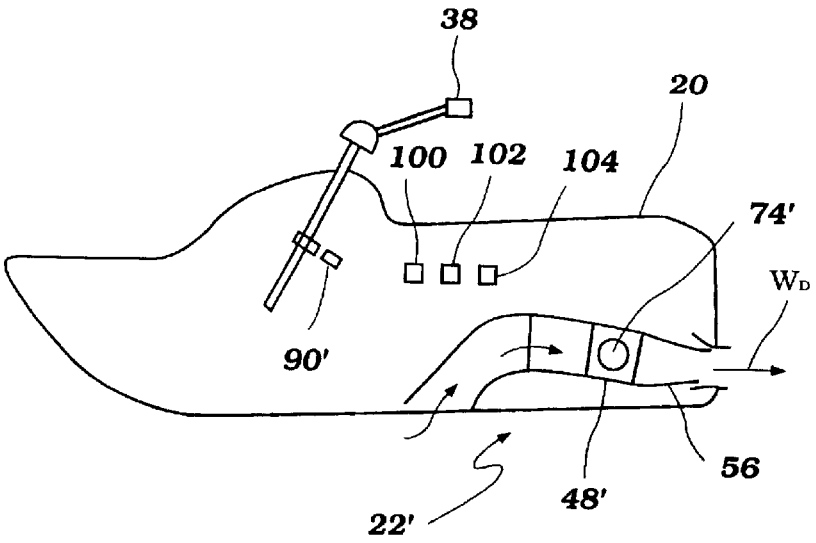
FIG. 8*a* illustrates a modification of the secondary thrust arrangement shown in FIG. 1.
Figure 8B:
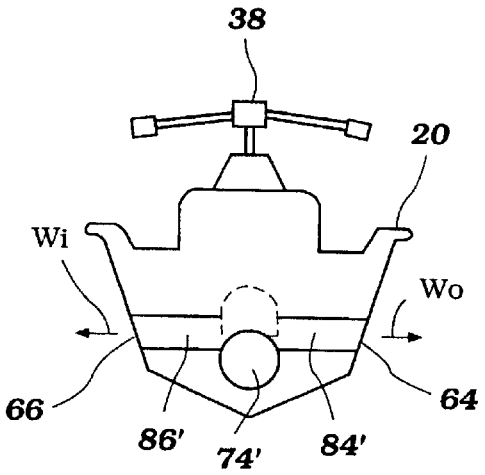
FIG. 8*b* illustrates a rear cross-sectional view of the secondary thrust arrangement shown in FIG. 8*a;*
Figure 8C:
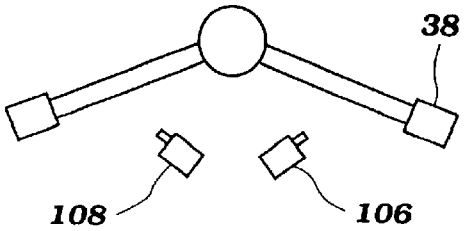
FIG. 8*c* is a schematic view of a handlebar assembly and position sensor arrangement of the secondary thrust arrangement shown in FIG. 8*a;*
Figure 9A:
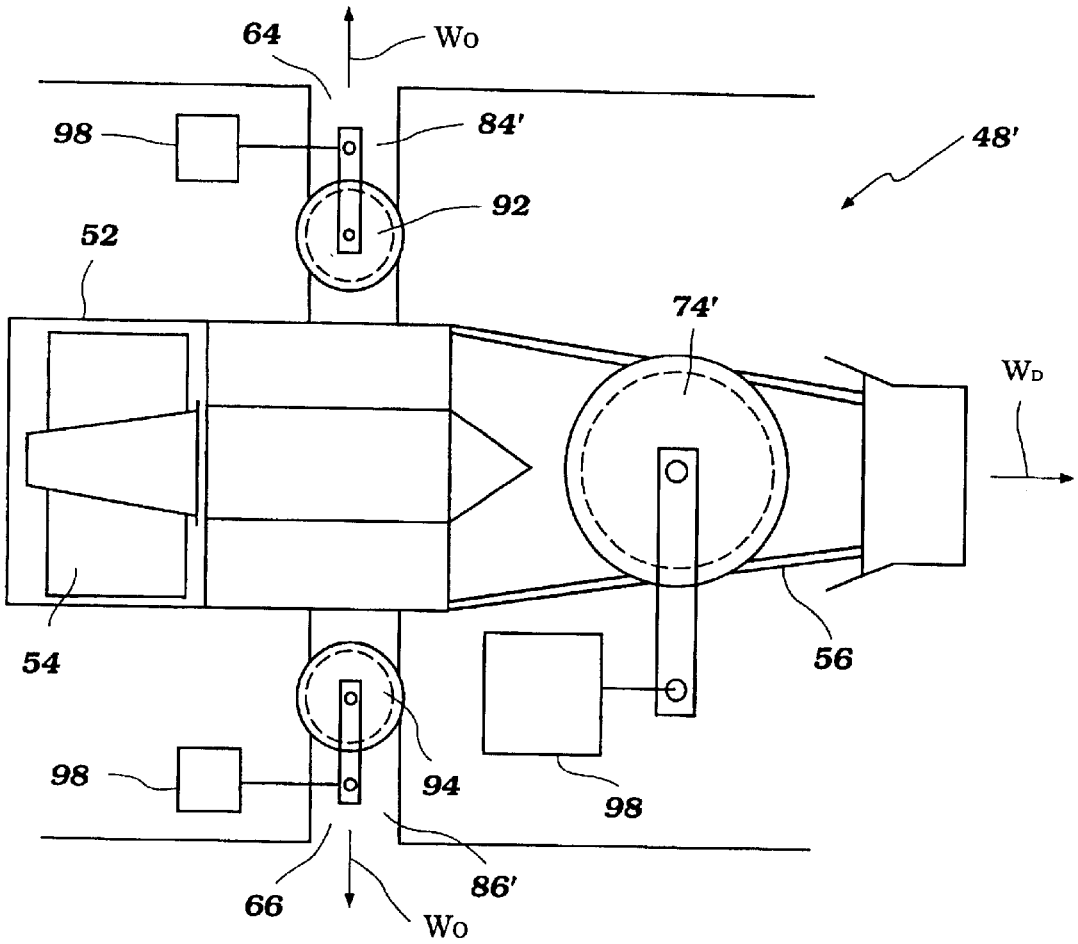
FIG. 9*a* is a schematic view of a first valve and a secondary valve arrangement of the secondary thrust arrangement shown in FIG. 8*a;*
Figure 9B:
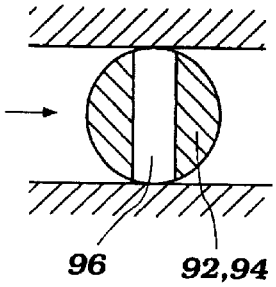
FIG. 9*b* is a schematic view of a closed position of a secondary valve of the secondary valve arrangement shown in FIG. 9*a;*
Figure 9C:
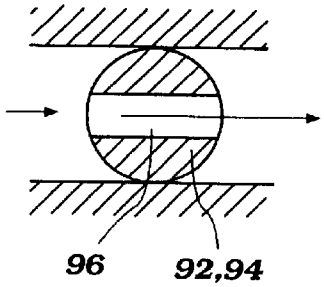
FIG. 9*c* is a schematic view of an open position of a secondary valve of the secondary valve arrangement shown in FIG. 9*a;*

FIGS. 8 through 10 illustrate a modification 22' of the secondary thrust arrangement 22 which is similar to the above-described embodiment. Thus, like reference numerals will be used to described like components, except that a (') will be used to denote modified components.

The jet propulsion unit 48' of the present modification includes a primary valve 74'. The primary valve 74' selectively permits the issuance of water through the discharge nozzle 56.

The secondary flow passage 68' is comprised of the starboard outlet branch 84' and a port outlet branch 86'. The secondary valve arrangement 82' comprises a first valve 92 and a second valve 94. The first and second valves 92, 94 are pivotally supported in the starboard and port outlet branches 84', 86', respectively. Additionally, each valve 92, 94 includes a valve passage 96.

Each of the valves 92, 94 has a first position (FIG. 9*a*) in which the valve passage 96 is oriented such that water is prevented from flowing through the corresponding outlet branch 84', 86'(FIG. 9*b*). In addition, each of the valves 92, 94 are configured to pivot such that the valve passage 96 is oriented to allow water to pass through the corresponding outlet branch 84', 86'. A Preferably, each of the valves 74', 92, 94 are actuated by a corresponding servo motor 98 in a known manner.

The modification illustrated in FIGS. 8 through 10 includes a variety of sensors. Specifically, a throttle opening sensor 100 senses the angular velocity of a throttle valve in an air intake system of the engine 46. An engine speed sensor 102 senses the rotational speed of the engine 46. A watercraft speed sensor 104 senses the speed of the watercraft 20. Additionally, the handlebar position sensor 90' comprises a right turn switch 106 and left turn switch 108. Each of the switches 106, 108 senses when the handlebar assembly 38 is turned to a right most and a left most position, respectively. Alternatively, a handlebar position sensor 90' which senses the position of the handlebar assembly 38 at any point within its range of motion may be provided.

Figure 10C:
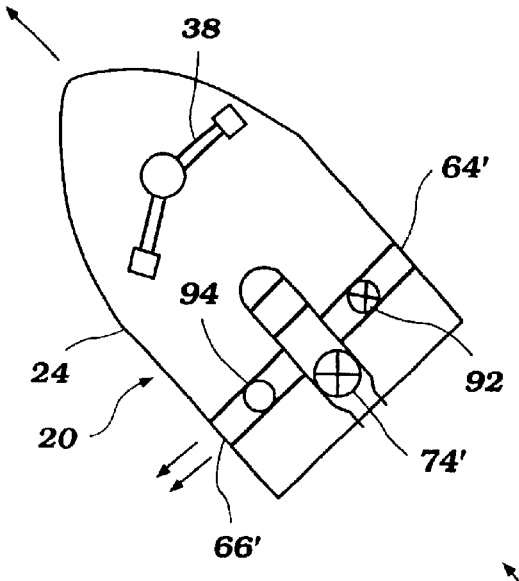
FIG. 10*c* illustrates the watercraft of FIG. 10*a* turning left in accordance with the operation of the secondary thrust arrangement of FIG. 8*a;*
Figure 10B:
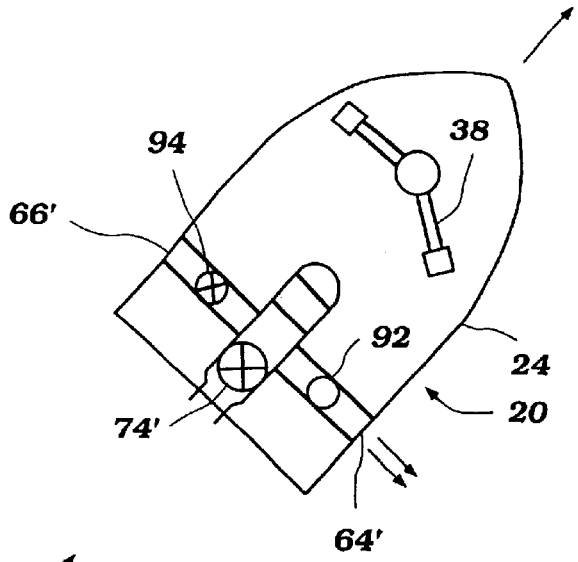
FIG. 10*b* illustrates the watercraft of FIG. 10*a* turning right in accordance with the operation of the secondary thrust arrangement of FIG. 8*a;*
Figure 10A:
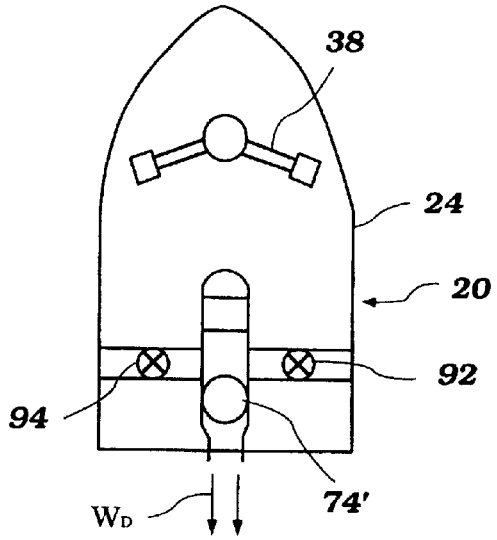
FIG. 10*a* illustrates the steering control of a watercraft in accordance with the secondary thrust arrangement of FIG. 8*a;*

With reference to FIGS. 10*a*–10*c*, the operation of the second embodiment of the jet propulsion unit 48 of the present invention is illustrated. Each of the valves 74', 92, 94 are shown schematically by a circle. An "X" through the circle indicates that the valve is substantially closed and an open circle indicates that the valve is open wherein a flow of water passes through the valve.

In a situation where the handlebar assembly 38 is in a neutral position, only the primary valve 74' is open. Thus, water is only discharged substantially rearwardly through the discharge nozzle 56 and the watercraft 20 is propelled forward (FIG. 10*a*).

When the handlebar assembly 38 is turned sufficiently to the right, the right turn switch 106 senses that the handlebar assembly 38 is in a right-most position. If the angular velocity of the throttle valve detected by the throttle opening sensor 100 is greater than a predetermined value (i.e., when the operator has abruptly released the throttle control lever 76), and if the speed of the engine 46 detected by the engine speed sensor 102 and the speed of the watercraft 20 detected by the watercraft speed sensor 104 are both beyond a predetermined value (i.e., when engine speed and watercraft speed are high), the right turn switch 106 operates to close the primary valve 74' and the second valve 94. Simultaneously, the engine speed is adjusted automatically, regardless of the position of the throttle control lever 76, to a value sufficient to provide thrust for steering the watercraft 20. Accordingly, substantially all the water is discharged through the first valve 92 and is issued through the starboard side discharge port 64' and the watercraft 20 turns to the right (FIG. 10*b*).

Likewise, when the handlebar assembly 38 is turned sufficiently to the left, the left turn switch 108 senses that the handlebar assembly 38 is in a left-most position. If the angular velocity of the throttle valve detected by the throttle opening sensor 100 is greater than a predetermined value and both the speed of the engine 46 detected by the engine speed sensor 102 and the speed of the watercraft 20 detected by the watercraft speed sensor 104 are both beyond a predetermined value, the left turn switch 108 operates to close the primary valve 74' and the first valve 92. Again, the engine speed is adjusted automatically, regardless of the position of the throttle control lever 76, to a value sufficient to provide thrust for steering the watercraft 20. Accordingly, substantially all water passes through the second valve 94 and is issued from the port side discharge port 66' and the watercraft 20 turns to the left (FIG. 10*c*).

Advantageously, with such a construction, the orientation of the outlet branches 84', 86' produce a substantially lateral thrust, thereby enhancing maneuverability of the watercraft 20. In prior art watercraft, steering of the watercraft under similar conditions is compromised because the range of motion of the steering nozzle is limited and a substantially lateral thrust cannot be achieved.

Thus, in prior art watercraft, only a partial component of the thrust force acts to turn the watercraft, while an additional component acts to propel the watercraft in a forward direction.

FIGS. 11 through 17 illustrate a further modification 22" of the secondary thrust arrangement illustrated in FIG. 1. The present modification is similar to the above-described arrangements, thus, like reference numerals will be used to describe like components, except that a (") will be used to denote modified components.

Figure 12A:
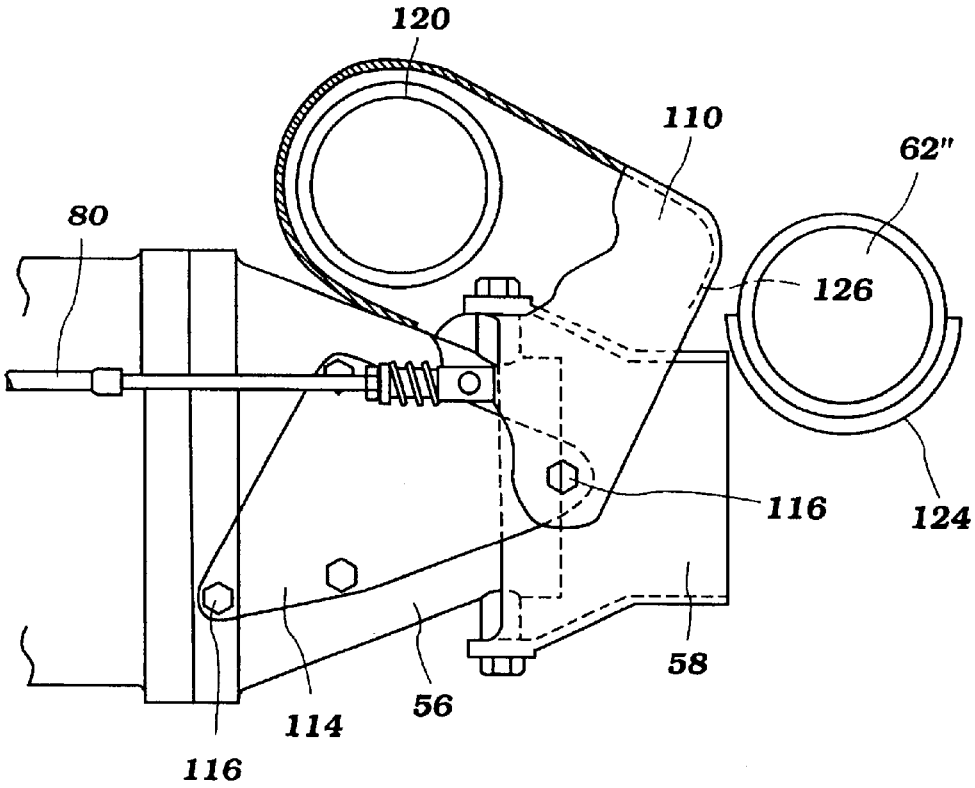
FIG. 12*a* is an enlarged side elevational view of a discharge nozzle and reverse thrust deflector arrangement constructed in accordance with the secondary thrust arrangement shown in FIG. 11 with the thrust deflector in a raised position.
Figure 12B:
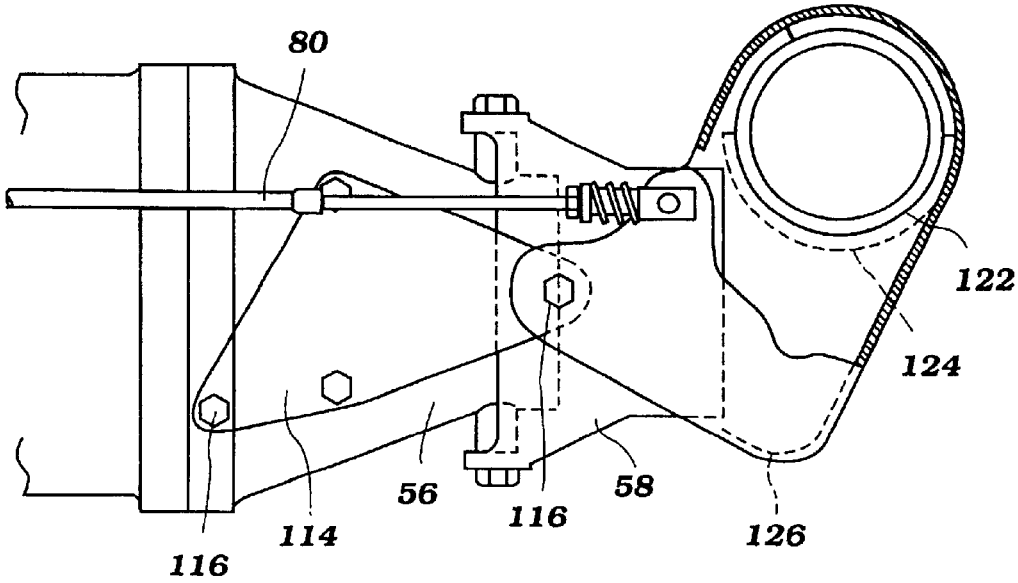
FIG. 12*b* is the discharge nozzle and reverse thrust deflector arrangement shown FIG. 12*a* with the thrust deflector in a lowered position.
Figure 13:
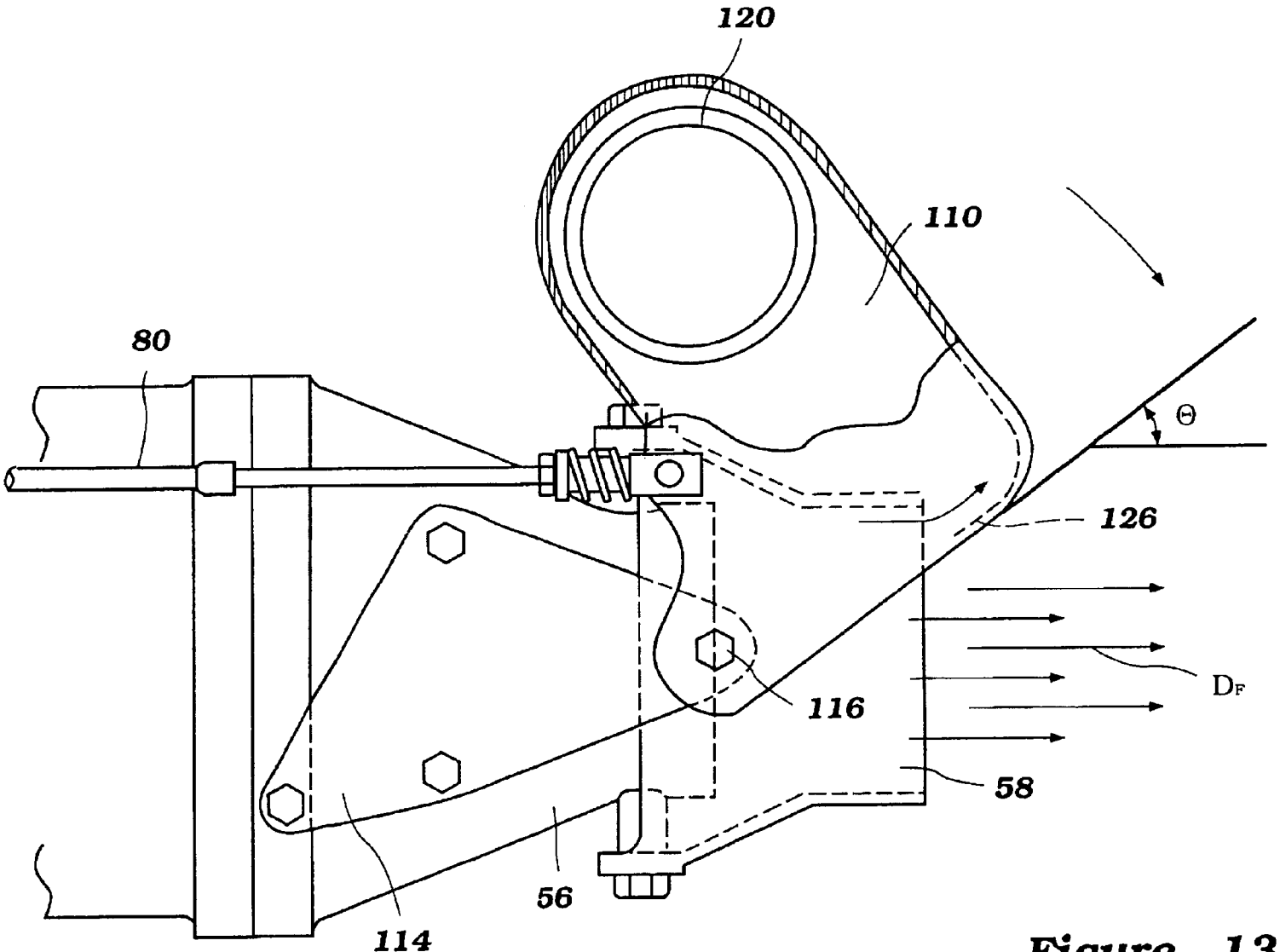
FIG. 13 is a side elevational view of a modification of the reverse thrust deflector shown in FIG. 12*a;*

With reference to FIGS. 11 through 13, the primary valve 74" comprises a water diverter bucket assembly 110. The bucket assembly 110 is pivotally arranged relative to the steering nozzle 58 to assume at least a first, or raised position, and a second, or lowered position. In the raised position, the bucket assembly 110 is positioned as such that water may be discharged substantially unimpeded from the steering nozzle 58. In a lowered position, the bucket assembly 110 is arranged such that substantially all water issued from the steering nozzle 58 is diverted by the bucket assembly 110.

As illustrated in FIG. 11, discharge ports 64, 66 are located on starboard and port sides of a bow portion 32 of the hull 24. Additionally, a pair of secondary inlets 62" are provided on a side wall of the tunnel 44 and disposed on lateral sides of the steering nozzle 58. Each one of a pair of secondary flow passages 68" connect the pair of secondary inlets 62" to one of the starboard and port side discharge ports 64, 66.

The handlebar assembly 38 includes the throttle control lever 76 which is configured to adjust the engine speed in a known manner and the secondary control lever 78 additionally configured to adjust the engine speed in a known manner. As in the secondary thrust arrangement 22, both control levers 76, 78 are connected to a throttle valve of the engine 46 through a servo motor arrangement. The secondary control lever 78 is configured to adjust the engine speed to a predetermined level, or to adjust the engine speed in accordance with the position of the secondary control lever 78. In addition, the secondary control lever 78 is configured to move the bucket assembly 110 between its first and second position.

A pair of bowden wires 80 connect the secondary control lever 78 to a conversion device 112 and connect the conversion device 112 to the bucket assembly 110. The conversion device 112 is configured to multiply the actuation force and stroke of the secondary control lever 78 to achieve the necessary actuation force and stroke required to pivot the bucket assembly 110 between its first and second positions.

As shown in FIGS. 12*a*, 12*b* and 13, the bucket assembly 110 is preferably pivotally supported on a pair of support brackets 114. The support brackets 114 are mounted on each lateral side of the discharge nozzle 56 by a plurality of bolts 116. The bucket assembly 110 pivots between its first and second position on an axis defined a pair of support pins 118.

The water diverter bucket assembly 110 additionally comprises a pair of lateral outlet ports 120 configured to guide water diverted by the bucket assembly 110 toward the pair of secondary inlets 62". The outer surfaces of the lateral outlet ports define engagement surfaces 122.

A pair of stops 124 are formed in the tunnel 44 and correspond with each secondary inlet 62". The stops 124 are preferably semicircular in shape and are configured to support at least a bottom and rearward portion of the engagement surfaces 122 of the lateral outlet port 120 such that the lateral outlet ports 120 are substantially aligned with the secondary inlets 62". With such a construction, water diverted by the bucket assembly 110 is guided through the lateral outlet ports 120 and into the secondary inlets 62". Additionally, the stops 124 define the second, or lowered, position of the bucket assembly 110 when supporting the engagement surfaces 122. The stops 124 also provide support to the bucket assembly 110 in response to the force generated by water discharging from the steering nozzle 58.

With reference to FIG. 13, a guide surface 126 is provided on the water diverter bucket assembly 110. The guide surface 126 is arranged to contact the water issuing from the steering nozzle 58 at an angle (θ) that is 90 degrees, or less, relative to the flow direction ($D_F$) of the water. Advantageously, with such a construction, the bucket assembly 110 is assisted in its downward movement from its first position to its second position by a force imparted on the guide surface 126 by water discharging from the steering nozzle 58.

With reference to FIGS. 14*a*–14*d*, the water diverter bucket assembly 110 preferably includes a partition 128. The partition is a substantially vertical wall configured to bisect a jet stream of water being discharged from the steering nozzle 58, when the steering nozzle 58 is in a neutral position. However, when the steering nozzle 58 is pivoted to the right the partition 128 directs a greater volume of water to the secondary inlet 62" disposed on the starboard side of the hull 24. Similarly, when the steering nozzle 58 is pivoted to the left, the partition 128 directs a greater volume of water to the secondary inlet 62" disposed on the port side of the hull 24 (illustrated by the arrows in FIG. 14*d*).

With a construction substantially as described above, enhanced steering control and reverse movement of the watercraft 20 are achieved in a similar manner to that described above with reference to FIGS. 1–5. Desirably, the present modification follows an operational sequence substantially similar to that described above with respect to FIGS. 6 and 7.

FIGS. 15*a*–15*c* illustrate a modification 22'" of the secondary thrust arrangement illustrated in FIG. 11. Thus, like reference numerals will be used to described like components, except that a ('") will be used to denote modified components. In the present modification, the pair of secondary inlets 62" are disposed above a stream of water issuing from the steering nozzle 58, on an upper wall of the tunnel 44. Both the secondary flow passages 68 and the discharge ports 64'", 66'" are disposed in the upper deck portion 28 of the hull 24. Advantageously, this construction allows the secondary flow passages 68 to pass through the same elevation as the center of gravity 72 of the watercraft 20 when the center of gravity 72 is disposed above the lower hull portion 26, such as may be the case when employing a four-stroke engine for powering the jet propulsion unit 48.

As illustrated in FIGS. 15*a* and 16, the starboard side and port side discharge ports 64'", 66'" may be configured to discharge water at a downward angle (illustrated by the arrow $W_T$). Advantageously, such a construction produces an upward force on the bow portion 32 of the watercraft 20 when the secondary thrust arrangement 22 is actuated. This arrangement is useful in inhibiting "diving" of the bow portion 32 of the watercraft hull 24 in response to sudden deceleration of the watercraft 20. "Diving" of the bow portion 32 occurs, at least in part, because the watercraft normally travels in a forward direction with only a rear portion of the hull 24 submerged, with the bow portion 32 elevated above the water surface. Thus, the watercraft 20 travels at a "planing angle" with respect to the water surface. Upon sudden deceleration of the watercraft 20 (i.e., the operator rapidly releases the throttle control lever 76), the watercraft 20 cannot maintain the planing angle, due to an absence of forward thrust, and the bow portion 32 drops into contact with the water surface. This "diving" of the bow portion 32 may be uncomfortable for the operator and any passengers. The secondary thrust arrangement 22 advantageously may be actuated by the operator to reduce, or eliminate, the "diving" effect of the bow portion 32, thereby improving comfort and enhancing the handling of the watercraft 20.

With reference to FIG. 17, the pair of secondary flow passages 68 are arrangement within a cavity 130 defined by the liner 47 and the lower hull portion 26 of the watercraft hull 24. Alternatively, the pair of cavities 130 may function as the secondary flow passages and the individual members comprising the secondary flow passages 68 may be omitted. Advantageously, this arrangement may be used with any of the disclosed modifications 22, 22', 22" and 22'".

Although this invention has been described in terms of certain preferred embodiments, other embodiments apparent to those of ordinary skill in the art are also within the skill of this invention. Accordingly, the scope of the invention is intended to be defined only by the claims that follow.

What is claimed is:

1. A watercraft comprising a hull, the hull including a lower hull portion and an upper deck portion, a handlebar assembly disposed on the upper deck portion, an engine compartment defined between the lower hull portion and upper deck portion, an internal combustion engine disposed in the engine compartment, a jet propulsion unit comprising a water inlet, a discharge nozzle, an impeller driven by the internal combustion engine, and a steering nozzle disposed on a downstream side of the discharge nozzle, the steering nozzle being configured to pivot about a substantially vertical axis, the jet propulsion unit configured to, in a first mode, discharge pressurized water from the steering nozzle in a substantially rearward direction from the watercraft, the jet propulsion unit additionally configured to, in a second mode, discharge pressurized water through at least one discharge port disposed on an outer surface of the hull, wherein the at least one discharge port is configured to discharge water at a downward angle when the watercraft is in an uprght position.

2. The watercraft of claim 1, additionally comprising at least one secondary flow passage having a secondary inlet disposed downstream of the impeller, the at least one secondary flow passage connecting the secondary inlet with the at least one discharge port.

3. The watercraft of claim 2, additionally comprising a primary valve, the primary valve being configured such that substantially all of the pressurized water is directed in a substantially rearward direction when the jet propulsion unit is in the first mode and substantially all of the pressurized water is directed toward the secondary inlet when the valve is in the second mode.

4. The watercraft of claim 3, additionally comprising a control assembly configured to be actuated by a rider of the watercraft, the control assembly being configured to operate the primary valve.

5. The watercraft of claim 4, wherein the control assembly comprises a control lever connected to the handlebar of the watercraft.

6. The watercraft of claim 1, wherein the at least one discharge port is disposed above a waterline of the watercraft when the watercraft is planing.

7. The watercraft of claim 1, wherein the at least one discharge port is located in a bow portion of the hull.

8. The watercraft of claim 1, wherein the at least one discharge port comprises a starboard side discharge port and a port side discharge port.

9. The watercraft of claim 8, wherein the starboard discharge port is disposed on a laterally facing starboard side of the hull and the port discharge port is disposed on a laterally facing port side of the hull.

10. The watercraft of claim 2, wherein the at least one secondary flow passage comprises at least a first flow passage portion and a second flow passage portion.

11. The watercraft of claim 10, wherein the first flow passage portion and the second flow passage portion are arranged so as to be symmetrical about a longitudinal axis of the watercraft.

12. The watercraft of claim 3, wherein the primary valve comprises a bucket pivotally connected to the hull to pivot about a generally horizontal axis, the bucket being substantially raised above the steering nozzle in a first position when the jet propulsion unit is in the first mode and being substantially lowered such that the bucket is positioned behind the steering nozzle in a second position when the jet propulsion unit is in the second mode.

13. The watercraft of claim 12, wherein the bucket additionally comprises at least one engagement surface, at least one stop on the hull positioned at least partially below the secondary inlet, the at least one engagement surface being configured to contact the at least one stop to defines the second position of the bucket.

14. The watercraft of claim 13, wherein the at least one stop is configured to engage a rearward portion of the at least one engagement surface.

15. A watercraft comprising a hull, the hull including a lower hull portion and an upper deck portion, a handlebar assembly disposed on the upper deck portion, an engine compartment defined between the lower hull portion and upper deck portion, an internal combustion engine disposed in the engine compartment, a jet propulsion unit comprising a water inlet, a discharge nozzle, an impeller driven by the internal combustion engine, a steering nozzle disposed on a downstream side of the discharge nozzle, the steering nozzle being configured to pivot about a substantially vertical axis, the jet propulsion unit configured to, in a first mode, discharge pressurized water from the steering nozzle in a substantially rearward direction from the watercraft, the jet propulsion unit additionally configured to, in a second mode, discharge pressurized water through at least one discharge port disposed on an outer surface of the hull, the watercraft further comprising at least one secondary flow passage having a secondary inlet disposed downstream of the impeller, the at least one secondary flow passage connecting the secondary inlet with the at least one discharge port, a primary valve, the primary valve being configured such that substantially all of the pressurized water is directed in a substantially rearward direction when the jet propulsion unit is in the first mode and substantially all of the pressurized water is directed toward the secondary inlet when the valve is in the second mode, and a control assembly configured to be actuated by a rider of the watercraft, the control assembly being configured to operate the primary valve, wherein the upper hull portion of the watercraft additionally comprises at least one foot well, the control assembly comprising a foot pedal disposed proximate the foot well to be actuated by a foot of a rider of the watercraft.

16. A watercraft comprising a hull, the hull including a lower hull portion and an upper deck portion, a handlebar assembly disposed on the upper deck portion, an engine compartment defined between the lower hull portion and upper deck portion, an internal combustion engine disposed in the engine compartment, a jet propulsion unit comprising a water inlet, a discharge nozzle, an impeller driven by the internal combustion engine, a steering nozzle disposed on a downstream side of the discharge nozzle, the steering nozzle being configured to pivot about a substantially vertical axis, the jet propulsion unit configured to, in a first mode, discharge pressurized water from the steering nozzle in a substantially rearward direction from the watercraft, the jet propulsion unit additionally configured to, in a second mode, discharge pressurized water through at least one discharge port disposed on an outer surface of the hull, the watercraft further comprising at least one secondary flow passage having a secondary inlet disposed downstream of the impeller, the at least one secondary flow passage connecting the secondary inlet with the at least one discharge port, a primary valve, the primary valve being configured such that substantially all of the pressurized water is directed in a substantially rearward direction when the jet propulsion unit is in the first mode and substantially all of the pressurized water is directed toward the secondary inlet when the valve is in the second mode, and a control assembly configured to be actuated by a rider of the watercraft, the control assembly being configured to operate the primary valve, wherein the control assembly is configured to increase the speed of the engine to a predetermined value when the control assembly is actuated.

17. The watercraft of claim 16, additionally comprising a throttle lever connected to the handlebar assembly, the throttle lever configured to adjust the speed of the engine, the control assembly configured to adjust the speed of the engine to a predetermined value when the control assembly is actuated, despite the position of the throttle lever.

18. The watercraft of claim 16, wherein the predetermined value is greater than the idle speed of the engine.

19. A watercraft comprising a hull, the hull including a lower hull portion and an upper deck portion, a handlebar assembly disposed on the upper deck portion, an engine compartment defined between the lower hull portion and upper deck portion, an internal combustion engine disposed in the engine compartment, a jet propulsion unit comprising a water inlet, a discharge nozzle, an impeller driven by the internal combustion engine, a steering nozzle disposed on a downstream side of the discharge nozzle, the steering nozzle being configured to pivot about a substantially vertical axis, the jet propulsion unit configured to, in a first mode, discharge pressurized water from the steering nozzle in a substantially rearward direction from the watercraft, the jet propulsion unit additionally configured to, in a second mode, discharge pressurized water through at least one discharge port disposed on an outer surface of the hull, the watercraft further comprising at least one secondary flow passage having a secondary inlet disposed downstream of the impeller, the at least one secondary flow passage connecting the secondary inlet with the at least one discharge port, and a primary valve, the primary valve being configured such that substantially all of the pressurized water is directed in a substantially rearward direction when the jet propulsion unit is in the first mode and substantially all of the pressurized water is directed toward the secondary inlet when the valve is in the second mode, wherein the at least one discharge port comprises a first discharge port and a second discharge port, additionally comprising a secondary valve arrangement configured to direct pressurized water to at least one of the first discharge port and the second discharge port.

20. The watercraft of claim 19, wherein the secondary valve arrangement has at least a first position, a second position and a neutral position, the secondary valve arrangement directing pressurized water substantially equally to the first and second discharge ports when the secondary valve arrangement is in the neutral position, the secondary valve arrangement directing more than half of the pressurized water to the second discharge port when the secondary valve arrangement is in the first position and the secondary valve arrangement directing more than half of the pressurized water to the first discharge port when the secondary valve arrangement is in the second position.

21. The watercraft of claim 19, wherein the secondary valve arrangement is controlled by movement of the handlebar assembly.

22. The watercraft of claim 19, wherein the first and second discharge ports are disposed on starboard and port sides of a bow portion of the hull, respectively.

23. A watercraft comprising a hull, the hull including a lower hull portion and an upper deck portion, a handlebar assembly disposed on the upper deck portion, an engine compartment defined between the lower hull portion and upper deck portion, an internal combustion engine disposed in the engine compartment, a jet propulsion unit comprising a water inlet, a discharge nozzle, an impeller driven by the internal combustion engine, a steering nozzle disposed on a downstream side of the discharge nozzle, the steering nozzle being configured to pivot about a substantially vertical axis, the jet propulsion unit configured to, in a first mode, discharge pressurized water from the steering nozzle in a substantially rearward direction from the watercraft, the jet propulsion unit additionally configured to, in a second mode, discharge pressurized water through at least one discharge port disposed on an outer surface of the hull, the watercraft further comprising at least one secondary flow passage having a secondary inlet disposed downstream of the impeller, the at least one secondary flow passage connecting the secondary inlet with the at least one discharge port, and a primary valve, the primary valve being configured such that substantially all of the pressurized water is directed in a substantially rearward direction when the jet propulsion unit is in the first mode and substantially all of the pressurized water is directed toward the secondary inlet when the valve is in the second mode, wherein the primary valve comprises a bucket pivotally connected to the hull to pivot about a generally horizontal axis, the bucket being substantially raised above the steering nozzle in a first position when the jet propulsion unit is in the first mode and being substantially lowered such that the bucket is positioned behind the steering nozzle in a second position when the jet propulsion unit is in the second mode, wherein the bucket additionally comprises a contact surface configured to contact water discharged from the steering nozzle at an intermediate position relative to the first position and the second position such that the discharged water assists the movement of the bucket from the first position to the second position.

24. A watercraft comprising a hull, the hull including a lower hull portion and an upper deck portion, a handlebar assembly disposed on the upper deck portion, an engine compartment defined between the lower hull portion and upper deck portion, an internal combustion engine mounted in the engine compartment, a jet propulsion unit comprising a water inlet, a discharge nozzle, an impeller driven by the internal combustion engine, a steering nozzle disposed on a downstream side of the discharge nozzle, the steering nozzle being configured to pivot about a substantially vertical axis, the jet propulsion unit configured to discharge pressurized water from the steering nozzle in a substantially rearward direction from the watercraft, means for diverting water from the jet propulsion unit through a discharge disposed on the hull, and means for applying an upward force on a bow portion of the watercraft.

25. A watercraft comprising a hull, the hull including a lower hull portion and an upper deck portion, a handlebar assembly disposed on the upper deck portion, an engine compartment defined between the lower hull portion and upper deck portion, an internal combustion engine disposed in the engine compartment, a jet propulsion unit comprising a water inlet, a discharge nozzle, an impeller driven by the internal combustion engine, a steering nozzle disposed on a downstream side of the discharge nozzle, the steering nozzle being configured to pivot about a substantially vertical axis, the jet propulsion unit configured to, in a first mode, discharge pressurized water from the steering nozzle in a substantially rearward direction from the watercraft, the jet propulsion unit additionally configured to, in a second mode, discharge pressurized water through at least one discharge port disposed on an outer surface of the hull, the watercraft further comprising at least one secondary flow passage having a secondary inlet disposed downstream of the impeller, the at least one secondary flow passage connecting the secondary inlet with the at least one discharge port, and a primary valve, the primary valve being configured such that substantially all of the pressurized water is directed in a substantially rearward direction when the jet propulsion unit is in the first mode and substantially all of the pressurized water is directed toward the secondary inlet when the valve is in the second mode, wherein the primary valve comprises a bucket pivotally connected to the hull to pivot about a generally horizontal axis, the bucket being substantially raised above the steering nozzle in a first position when the jet propulsion unit is in the first mode and being substantially lowered such that the bucket is positioned behind the steering nozzle in a second position when the jet propulsion unit is in the second mode, wherein the at least one secondary inlet comprises a first inlet and a second inlet, the bucket including a partition configured to divide water discharged from the steering nozzle into at least two secondary flows, each half of the of the secondary flows being directed toward one of the first and second lets.

26. The watercraft of claim 25, wherein the steering nozzle has a neutral position and at least a first rotated position and a second rotated position, the partition being configured to direct substantially all water discharged from the steering nozzle to the first inlet when the steering nozzle is in the first rotated position and to direct substantially all water discharged from the steering nozzle to the second inlet when the steering nozzle is in the second rotated position.

27. A watercraft comprising a hull, the hull including a lower hull portion and an upper deck portion, an engine compartment defined between the lower hull portion and upper deck portion, an internal combustion engine disposed in the engine compartment, a jet propulsion unit powered by the internal combustion engine, the jet propulsion unit including a discharge nozzle, the jet propulsion unit being configured to discharge water through the discharge nozzle so as to produce at least a forward thrust, a steering nozzle configured to selectively divert the water discharged through the discharge nozzle, at least one discharge port disposed on the hull and configured to produce a steering thrust, and a throttle valve configured to control an amount of air flowing into the engine and a throttle valve velocity sensor configured to detect a velocity of movement of the throttle valve.

28. The watercraft according to claim 27, wherein the at least one discharge port comprises a first discharge port oriented to discharge water laterally toward a port side of the watercraft and a second discharge port oriented to discharge water laterally towards a starboard side of the watercraft.

29. The watercraft according to claim 28 additionally comprising a valve arrangement configured to control a flow water through the first and second discharge ports in response to a signal from the throttle valve velocity sensor.

* * * * *

UNITED STATES PATENT AND TRADEMARK OFFICE

CERTIFICATE OF CORRECTION

PATENT NO. : 6,530,812 B2
DATED : March 11, 2003
INVENTOR(S) : Satoshi Koyano et al.

It is certified that error appears in the above-identified patent and that said Letters Patent is hereby corrected as shown below:

Column 14,
Line 40, please change “uprght” to -- upright --.

Signed and Sealed this

Eleventh Day of May, 2004

JON W. DUDAS
*Acting Director of the United States Patent and Trademark Office*